US006321511B1

(12) United States Patent
O'Connor et al.

(10) Patent No.: US 6,321,511 B1
(45) Date of Patent: Nov. 27, 2001

(54) PACKAGING A STRIP OF MATERIAL WITH COMPRESSION TO REDUCE VOLUME

(75) Inventors: Lawrence J. O'Connor; Darrell Van Mol, both of Winnipeg (CA)

(73) Assignee: BKI Holding Corporation, Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/251,944

(22) Filed: Feb. 18, 1999

Related U.S. Application Data

(63) Continuation-in-part of application No. 09/081,826, filed on May 20, 1988, now Pat. No. 5,987,851, and a continuation-in-part of application No. 09/064,744, filed on Apr. 23, 1998, now Pat. No. 6,176,068, and a continuation-in-part of application No. 08/948,258, filed on Oct. 9, 1997, now abandoned, which is a continuation-in-part of application No. 08/878,826, filed on Jun. 19, 1997, now Pat. No. 6,035,608, which is a continuation-in-part of application No. 08/939,444, filed on Sep. 29, 1997, now abandoned, which is a continuation-in-part of application No. 08/899,737, filed on Jul. 8, 1997, now Pat. No. 5,927,051, and a continuation-in-part of application No. 08/878,826, filed on Jun. 19, 1997, now Pat. No. 6,035,608, and a continuation-in-part of application No. 08/876,402, filed on Jun. 16, 1997, now Pat. No. 5,921,064.

(51) Int. Cl.[7] ..... B65B 63/04; B65B 31/04; B65B 63/02; B65D 73/00

(52) U.S. Cl. ..... 53/429; 53/434; 53/438; 53/445; 206/494; 493/413

(58) Field of Search ..... 53/432, 434, 429, 53/438, 436, 116, 117, 527, 529, 445, 156, 157; 206/494; 493/413

(56) References Cited

U.S. PATENT DOCUMENTS

| | | |
|---|---|---|
| 32,761 | 7/1861 | Elliot . |
| 1,029,459 | 6/1912 | Quigley . |
| 1,463,918 | 8/1923 | Borroughs . |
| 1,489,833 | 4/1924 | Keller . |
| 1,985,676 | 12/1934 | Hand . |
| 2,425,301 | 8/1947 | Browner . |
| 2,659,187 | 11/1953 | Barnes . |
| 3,245,680 | 4/1966 | Harrison et al. . |

(List continued on next page.)

FOREIGN PATENT DOCUMENTS

| | | |
|---|---|---|
| 181590 | 4/1951 | (AT) . |
| 22983/83 | 12/1983 | (AU) . |
| B-22983/83 | 12/1983 | (AU) . |
| 2 225 061 | 5/1972 | (DE) . |
| 2225061 | 12/1973 | (DE) . |
| 0 274 737 | 12/1987 | (EP) . |
| 0274737 | 12/1987 | (EP) . |
| 0 383 501 | 2/1990 | (EP) . |

(List continued on next page.)

*Primary Examiner*—Stephen F. Gerrity
(74) *Attorney, Agent, or Firm*—Darby & Darby

(57) ABSTRACT

A package has at least one stack of a strip of material repeatedly folded back and forth so that the stack contains a plurality of folded overlying strip portions of the strip. Each strip portion is folded relative to one next adjacent strip portion about a first fold line transverse to the strip and relative to a second next adjacent strip portion about a second fold line transverse to the strip and spaced from the first fold line. The strip portions form a plurality of first fold lines at each end of the stack. The stack can be arranged substantially upright and has a splice tail portion of the strip extending from the bottom strip portion beyond an end of the stack to be accessible for splicing. The entire top surface and the entire bottom surface of the stack is compressed from an external force in a direction at right angles to the top surface and the bottom surface of the stack. The stack is engaged by packaging which maintains the compression.

32 Claims, 12 Drawing Sheets

U.S. PATENT DOCUMENTS

| | | |
|---|---|---|
| 3,285,405 | 11/1966 | Wanderer . |
| 3,321,889 | 5/1967 | Zubik et al. . |
| 3,351,992 | 11/1967 | Carter . |
| 3,429,095 | 2/1969 | Huson . |
| 3,499,261 | 3/1970 | Hulhorst et al. . |
| 3,627,306 | 12/1971 | Affupper . |
| 3,632,103 | 1/1972 | Nikitits . |
| 3,645,759 | 2/1972 | Heiligman . |
| 3,673,757 | 7/1972 | Willis . |
| 3,684,275 | 8/1972 | Schweitzer et al. . |
| 3,697,062 | 10/1972 | Mones et al. . |
| 3,729,367 | 4/1973 | Shore et al. . |
| 3,739,544 | 6/1973 | Hanemann . |
| 3,780,908 | 12/1973 | Fitzpatrick et al. . |
| 3,913,904 | 10/1975 | Occhetti . |
| 3,972,519 | 8/1976 | Melzer . |
| 4,053,151 | 10/1977 | Frezza . |
| 4,074,901 | 2/1978 | Catallo . |
| 4,097,039 | 6/1978 | Fischer . |
| 4,130,679 | 12/1978 | Breznak et al. . |
| 4,174,101 | 11/1979 | Frezza . |
| 4,201,029 | 5/1980 | Lerner et al. . |
| 4,240,854 | 12/1980 | Massey et al. . |
| 4,332,583 | 6/1982 | Stemmler et al. . |
| 4,406,650 | 9/1983 | Felix . |
| 4,418,514 | 12/1983 | Spann . |
| 4,427,404 | 1/1984 | Yamada . |
| 4,467,589 | 8/1984 | van Maanen . |
| 4,493,689 | 1/1985 | Affupper . |
| 4,499,707 | 2/1985 | Desjobert et al. . |
| 4,512,464 | 4/1985 | Slyvester . |
| 4,547,184 | 10/1985 | Bunch, Jr. . |
| 4,564,184 | 1/1986 | Rumpel . |
| 4,573,670 | 3/1986 | Felix . |
| 4,597,748 | 7/1986 | Wolf . |
| 4,603,817 | 8/1986 | O'Connor . |
| 4,670,001 | 6/1987 | Campbell et al. . |
| 4,715,925 | 12/1987 | Hofmeister et al. . |
| 4,716,706 | 1/1988 | Boeckmann . |
| 4,730,762 | 3/1988 | Felix . |
| 4,737,045 | 4/1988 | Koefferlein . |
| 4,815,405 | 3/1989 | Young, Jr. . |
| 4,824,426 | 4/1989 | DuFresne . |
| 4,828,540 | 5/1989 | Fordyce . |
| 4,829,918 | 5/1989 | Young, Jr. . |
| 4,846,454 | 7/1989 | Parkander . |
| 4,863,029 | 9/1989 | Koskol et al. . |
| 4,907,397 | 3/1990 | Goodman . |
| 4,941,374 | 7/1990 | Focke . |
| 5,029,828 | 7/1991 | Sato et al. . |
| 5,036,977 | 8/1991 | Schofield et al. . |
| 5,041,074 | 8/1991 | Zwimpfer . |
| 5,042,789 | 8/1991 | Hediger . |
| 5,047,003 | 9/1991 | Schmidlin et al. . |
| 5,064,179 | 11/1991 | Martin . |
| 5,085,624 | 2/1992 | Felix . |
| 5,087,140 | 2/1992 | Keeton et al. . |
| 5,104,366 | 4/1992 | Bunch . |
| 5,147,273 | 9/1992 | Rottmann et al. . |
| 5,177,934 | 1/1993 | Yamamoto . |
| 5,201,700 | 4/1993 | Meschi . |
| 5,205,808 | 4/1993 | Gebhardt . |
| 5,242,057 | 9/1993 | Cook et al. . |
| 5,290,226 | 3/1994 | Green, Jr. . |
| 5,348,527 | 9/1994 | Beckwith . |
| 5,358,140 | 10/1994 | Pellegrino . |
| 5,529,564 | 6/1996 | Hediger . |
| 5,558,318 | 9/1996 | Crowley et al. . |
| 5,616,113 | 4/1997 | Van Den Bergh . |
| 5,658,638 | 8/1997 | Pottenger . |
| 5,690,250 | 11/1997 | Gooding, Jr. et al. . |
| 5,730,695 | 3/1998 | Hauschild et al. . |

FOREIGN PATENT DOCUMENTS

| | | |
|---|---|---|
| 0383501 | 2/1990 | (EP) . |
| 1.357.816 | 7/1945 | (FR) . |
| 1357816 | 7/1964 | (FR) . |
| 883100 | 12/1958 | (GB) . |
| 883100 | 11/1961 | (GB) . |
| 2 028 774 A | 3/1980 | (GB) . |
| 2028774A | 3/1980 | (GB) . |
| 2 193 734 A | 2/1988 | (GB) . |
| 2193734A | 2/1988 | (GB) . |
| 57-47638 | 3/1982 | (JP) . |
| 5747638 | 3/1982 | (JP) . |
| 2-182666 | 7/1990 | (JP) . |
| 1555-205-A | 4/1990 | (SU) . |
| 1555205A | 4/1990 | (SU) . |
| 99/35073 | 7/1999 | (WO) . |
| WO 99/35073 | 7/1999 | (WO) . |

PACKAGING A STRIP OF MATERIAL WITH COMPRESSION TO REDUCE VOLUME

RELATED APPLICATIONS

This application is a continuation-in-part of (1) Application Ser. No. 08/939,444, filed Sep. 29, 1997 now abandoned, which is a continuation-in-part of application Ser. No. 08/876,402 filed Jun. 16, 1997, now U.S. Pat. No. 5,921,064 issued Jul. 13, 1999, application Ser. No. 08/878,826 filed Jun. 19, 1997, now U.S. Pat. No. 6,035,608 issued Mar. 14, 2000, and application Ser. No. 08/889,737 filed Jul. 8, 1997, now U.S. Pat. No. 5,927,051 issued Jul. 27, 1999; (2) application Ser. No. 08/948,256, filed Oct. 9, 1997, now U.S. Pat. No. 5,966,905 issued Oct. 19, 1999, which is a continuation-in-part of Application Ser. No. 08/889,737 filed Jul. 8, 1997, now U.S. Pat. No. 5,927,051 issued Jul. 27, 1999, which is a continuation-in-part of Ser. No. 08/878,826 filed Jun. 19, 1997, now U.S. Pat. No. 6,035,608 issued Mar. 14, 2000; (3) application Ser. No. 09/064,744, filed Apr. 23, 1998, now U.S. Pat. No. 6,176,068 issued Jan. 23, 2001; and (4) application Ser. No. 09/081,826 filed May 20, 1998 now U.S. Pat. No. 5,987,851 issued Nov. 23, 1999. The disclosure of each of the above applications is incorporated herein by reference.

BACKGROUND OF THE INVENTION

1. Field of Invention

This invention relates to a package of a continuous strip or sheet of pliable material and to a method for forming a package of a continuous strip or sheet of pliable material.

2. Description of Related Art

Previously packages of a continuous strip of material have been formed using a technique known as "festooning" in which the strip is folded back and forth to lay a series of strip portions back and forth with each portion being folded relative to the next about a line transverse to the strip. The technique of festooning has been available for many years and is used in packaging many different types of material but particularly material of a fibrous nature such as fabric, non-woven strips and the like. In this technique, the strip is conventionally guided into a receptacle such as a cardboard box while a first reciprocating movement causes portions of the strip to be laid across the receptacle and folded back and forth and a second reciprocating movement causes the positions of the portions to be traversed relative to the receptacle transversely to the portions. Normally the receptacle comprises a rigid rectangular container at least partly of cardboard having a base and four upstanding sides.

The purpose of the festooning method is for packaging the strip for supply to a machine using the strip. Some users prefer the festooned package relative to a wound package of this type of material. The festooned package contains a much greater length of material than a spirally wound pad. The festooned package can simply be located adjacent the machine without the necessity for any unwinding or support stand. In addition, both the leading end and the tail end of the package are available at the top of the package so that a series of the packages can be connected lead to tail to act as an extended supply. Yet further, since the material is simply laid into the package, there is less problem with tension control in the material as it is withdrawn from the package, in comparison with larger traverse wound packages where tension control of large packages can be a problem due to the inertia of the package thus requiring a driven unwind stand as well as material handling equipment for moving the large rolls. There is therefore no need when festooned packages are used for a complex unwind stand which takes up more space than may be available and involves significant cost.

Festooned packages are formed in a stiff container or box to properly enclose and contain the material and within which the material is stored during transportation for maintaining the material against compression and distortion due to the transfer of loads from surrounding packages. The cardboard container thus provides support for other similar stacked containers and prevents the transfer of loads from the stacked packages from causing excessive compression of packages at the bottom of a layer. The cardboard containers and the package structures used in the conventional arrangement however have a number of problems.

Firstly the container must be either recycled with the necessity of shipping the cardboard containers in the return direction to the supplier from the end user or they must be discarded, both at considerable expense.

Secondly the cardboard containers simply receive the material without significant compression so that there is wastage of space within the container due to the packaging of air with the material. In addition the conventional package structure does not minimize the amount of air spaces formed in the structure. The transportation costs of the material therefore are significantly increased by the large volume of the material which provides a density which is significantly below the optimum for most efficient transport.

Thirdly the presence of the essential box during formation of the structure provides a restriction to the proper control of the strip as it is laid down since the sides of the box provide limitations to the position and movement of the guide member controlling the strip.

Fourthly it has been noted that the sides of the box which are parallel to the strips as they are laid down do not closely confine the sides of the package structure with the significant danger that the strips can fall down between the edge of the package and the box side.

In addition, the conventional technique for forming the package in which each of the strips slit from a web of supply material is individually packaged at a separate festooning station is slow and requires a large amount of floor space for the large number of stations. Also the large area covered by the stations causes a significant distance to be traveled by the strip from the slitting station to the festooning station with the potential for strip tension problems and damage to the strip.

There remains therefore a significant requirement for a package of this general type but the techniques presently available are unsatisfactory for the above reasons leaving opportunity for an improved package structure.

SUMMARY OF THE INVENTION

It is one object of the present invention, therefore, to provide an improved package structure and a method of packaging a strip of material in which the stability of the package can be improved and the economics of transportation and storage of the package can be improved.

According to one aspect of the invention there is provided a package of a strip comprising:

at least one stack of a strip;

the strip having a first side edge, a second side edge, a first surface and a second surface;

in said at least one stack the strip being repeatedly folded back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of the at least one stack and a plurality of second fold lines at an opposed end of the at least one stack;

the strip portions being arranged such that the first surface of each strip portion lies directly in contact with the first surface of one next adjacent strip portion and such that the second surface of each strip portion lies directly in contact with the second surface of the other next adjacent strip portion;

the strip portions being arranged with the first side edges thereof lying directly on top of and aligned with the first side edges of others of the strip portions of the stack and with the second side edges thereof lying directly on top of and aligned with the second side edges of others of the strip portions;

the strip portions being arranged with the first and second surfaces thereof generally parallel to a top surface and bottom surface of the at least one stack with the strip continuous through the stack between a bottom strip portion and a top strip portion;

the at least one stack being substantially upright and having a splice tail portion of the strip extending from the bottom strip portion and extending beyond an end of the at least one stack so as to be accessible for splicing;

the entire top surface and the entire bottom surface of the at least one stack being under compression from an external force in a direction at right angles to the top surface and the bottom surface of the at least one stack; and the at least one stack being engaged by a packaging material which maintains the compression.

Preferably the packaging material comprises a closed bag surrounding the package from which air has been withdrawn and which is sealed against ingress of air.

Preferably the compression applied by said compression force is sufficient to reduce the thickness of each strip portion of said at least one stack.

Preferably the strip is fibrous such the each strip portion is compressed by expelling air from interstices between the fibers.

Preferably the packaging material comprises two rigid header plates, each engaging a respective one of a top surface and a bottom surface of the package and each applying pressure thereto for maintaining the compression.

Preferably the splice tail portion extends along the end of the stack and is folded about at least one fold line generally transverse to its length to define two folded strip portions.

Preferably the method includes providing a slip sheet between the two folded strip portions.

Preferably there is provided a spacer sheet between the fold lines at an end of the stack and the splice tail portion.

Preferably the package is maintained compressed in a direction at right angles to the strip portions of the at least one stack by an amount sufficient to form a rigid free standing package structure without rigid container walls.

Preferably there is provided a container member defining at least one pocket for containing and supporting the splice tail portion.

Preferably there is a plurality of the stacks arranged side by side without intervening rigid container walls and wherein there is provided for each stack a respective splice tail portion extending beyond an end of the respective stack and wherein there is provided a container member defining at least one pocket for containing and supporting the splice tail portions.

Preferably the container member includes a plurality of pockets each for receiving a respective one of the splice tail portions.

Preferably the container member comprises a spacer sheet between the fold lines at an end of the stack and the splice tail portions and at least one pocket carried on the spacer sheet for containing the splice tail portions.

Preferably each splice tail portion is connected by a splice to a top strip portion of a next adjacent stack to define a splice connection portion extending from the bottom strip portion of one stack to the top strip portion of the next adjacent stack and wherein the stacks are compressed such that a length of the splice connection portion is longer than the height of the compressed stacks and wherein an excess length portion of each splice connecting portions is inserted into the at least one pocket.

Preferably the at least one pocket comprises a sleeve mounted on an outer surface of the spacer sheet defining an open top and an open bottom.

Preferably each splice tail portion is connected by a splice to a top strip portion of a next adjacent stack to define a splice connection portion extending from the bottom strip portion of one stack to the top strip portion of the next adjacent stack and wherein the stacks are compressed such that a length of each splice connection portion is longer than the height of the compressed stacks and wherein a first excess length portion of each splice connecting portion is inserted into the open top of a respective one of the pockets and a second excess length portion of each splice connecting portion is inserted into the open bottom of a respective one of the pockets.

According to a second aspect of the invention there is provided a method of forming a package of a strip comprising:

providing at least one stack of a strip;

the strip having a first side edge, a second side edge, a first surface and a second surface;

in said at least one stack folding the strip repeatedly back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of the at least one stack and a plurality of second fold lines at an opposed end of the at least one stack;

arranging the strip portions such that the first surface of each strip portion lies directly in contact with the first surface of one next adjacent strip portion and such that the second surface of each strip portion lies directly in contact with the second surface of the other next adjacent strip portion;

arranging the strip portions with the first side edges thereof lying directly on top of and aligned with the first side edges of others of the strip portions of the stack and with the second side edges thereof lying directly on top of and aligned with the second side edges of others of the strip portions;

arranging the strip portions with the first and second surfaces thereof generally parallel to a top surface and bottom surface of the at least one stack with the strip continuous through the stack between a bottom strip portion and a top strip portion;

arranging the at least one stack substantially upright and having a splice tail portion of the strip extending from the bottom strip portion and extending beyond an end of the at least one stack so as to be accessible for splicing;

compressing the entire top surface and the entire bottom surface of the at least one stack from an external force in a direction at right angles to the top surface and the bottom surface of the at least one stack; and engaging the at least one stack by a packaging material which maintains the compression.

BRIEF DESCRIPTION OF THE DRAWINGS

Embodiments of the invention will now be described in conjunction with the accompanying drawings in which.

DETAILED DESCRIPTION OF PREFERRED EMBODIMENTS

As will be clear from the description of the following embodiments, the terms "layer", "stack", "end", "side", "top" and "bottom" as used herein are not intended to limit the package so described to any particular orientation. It will be fully clear that the package can be rotated to any desired orientation during formation, during transportation and storage, and during unfolding and will remain unchanged by that rotation. The terms are used herein because they assist the reader in visualizing the package and assist in providing clear consistency of terms.

As shown in FIGS. 1 to 4, a package comprises a generally rectangular body 10 formed from a strip or sheet 11 of a pliable material to be packaged and generally this material will be of a fibrous nature formed by woven or non-woven material although this is not essential to the package structure. Many materials of various thickness can be packaged using the techniques described herein provided they can accept the creasing necessary at the end of each portion.

Figure 2:
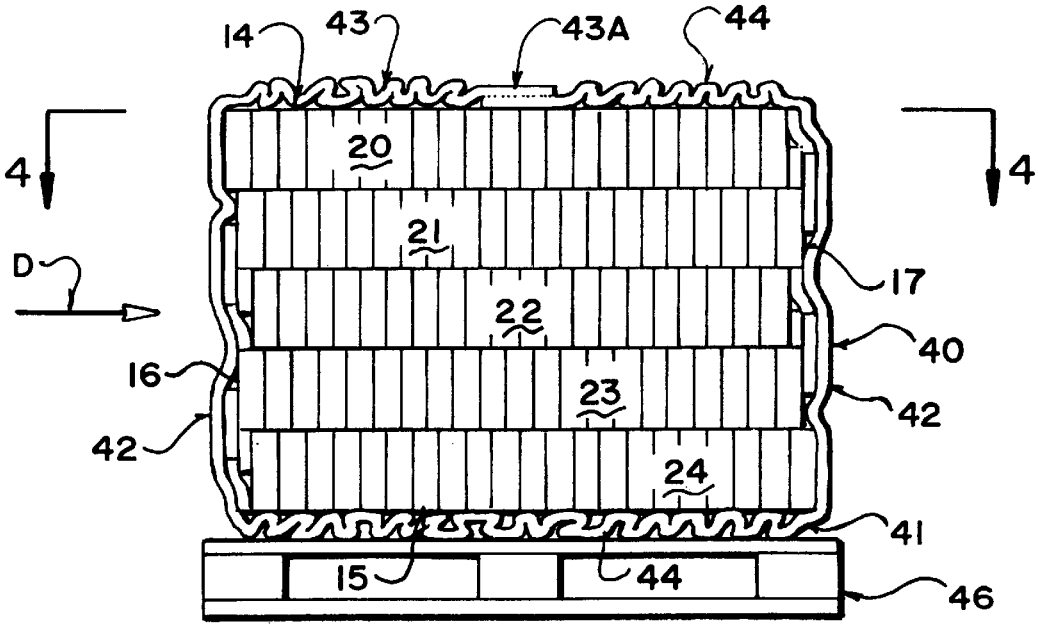
FIG. 2 is a cross sectional view along the lines 2—2 of FIG. 1, with the flexible packaging material and an optional pallet included and the package rotated to its normal transportation position with the layers horizontal.
Figure 3:
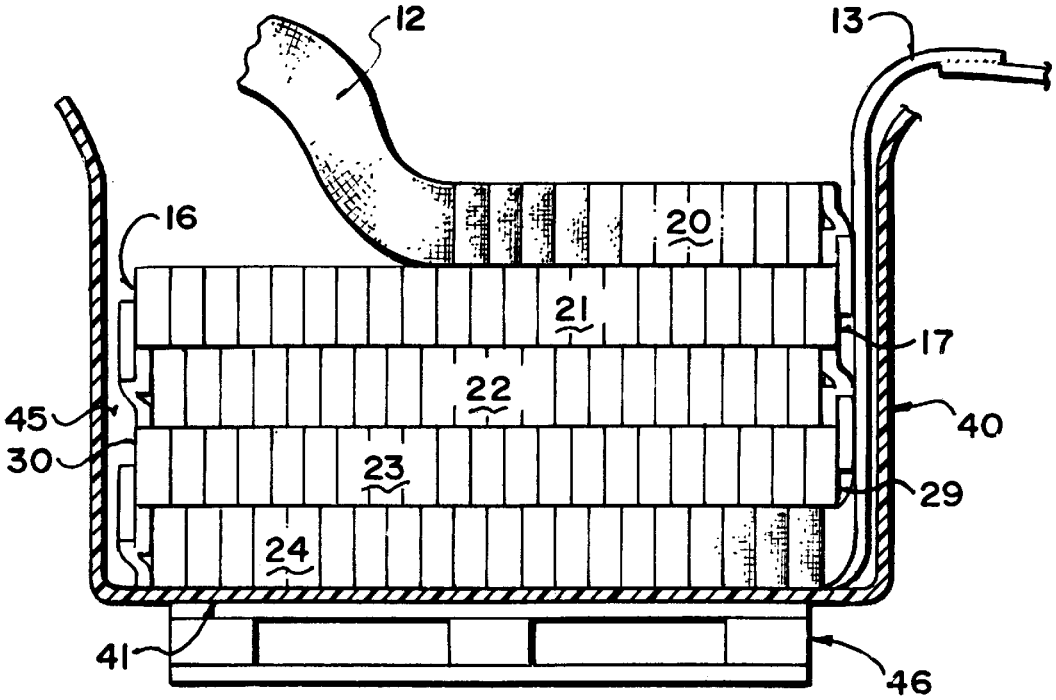
FIG. 3 is a partially schematic cross sectional view similar to that of FIG. 2 showing the package opened and the strip partly withdrawn.
Figure 4:
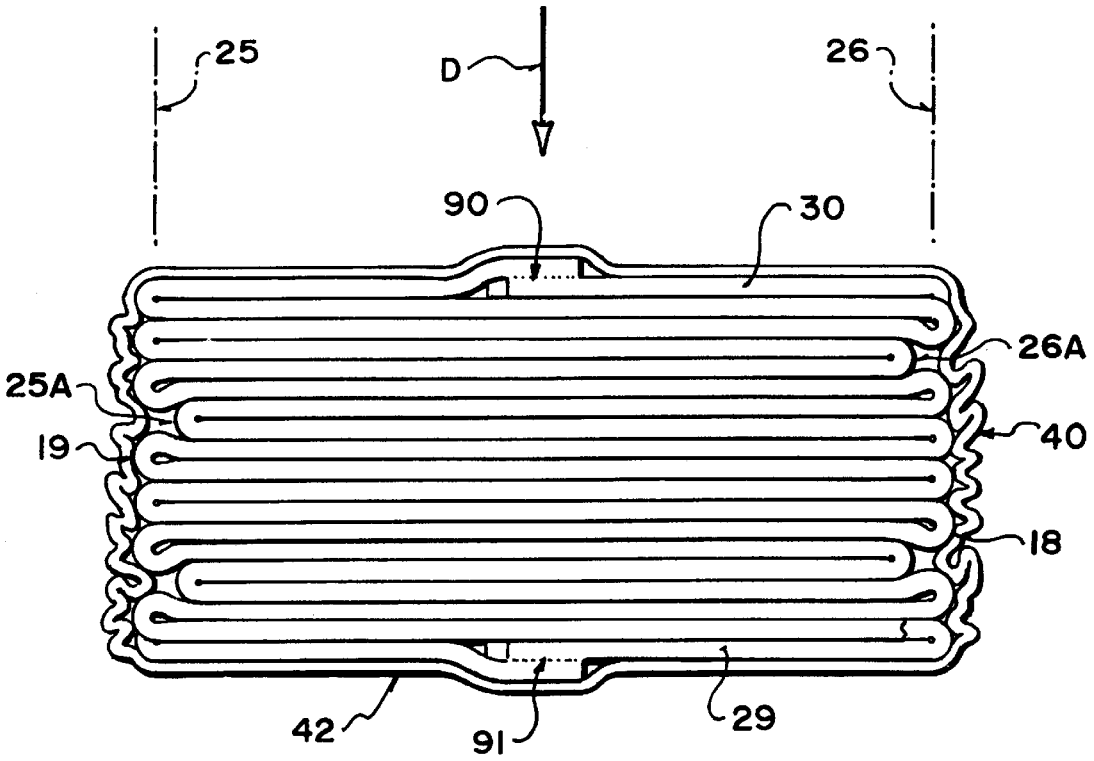
FIG. 4 is a cross sectional view along the lines 4—4 of FIG. 2.

The strip has a leading end 12 and a trailing end 13 of the package and otherwise is substantially continuous through the package. The package when oriented in a generally preferred position for transportation or use as shown in FIGS. 2, 3 and 4 has a top 14, a bottom 15, two sides 16 and 17 and two ends 18 and 19.

The package is formed by a plurality of layers or stacks of strips. In the embodiments and the orientation shown in FIGS. 1 to 4, there are five layers or stacks of the strip indicated respectively at 20, 21, 22, 23 and 24. The layers are parallel and an outer side of the layer 20 forms a side surface 14 of the package and an outer side of the layer 24 forms a second side surface 15 of the package. The package thus has end layers 20 and 24 and a plurality (in this embodiment three) of intermediate layers.

It will be appreciated that the dimensions of the package can of course be varied in accordance with the requirement so that the number of stacks, the length of each stack and the height of each stack can be varied. For example, in FIG. 7 the package is shown as having eight stacks. The package can also be formed as a single stack.

Figure 1:
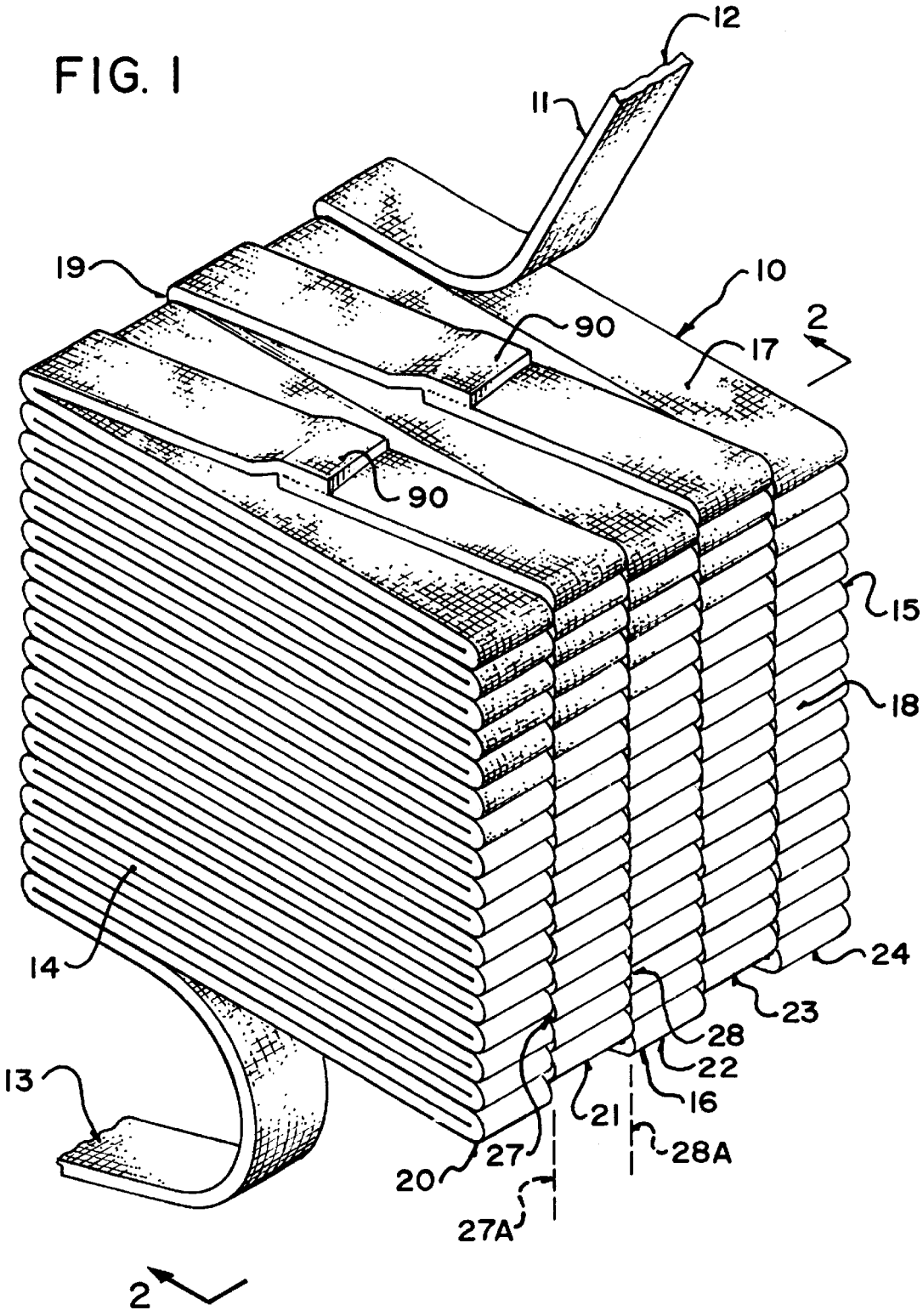
FIG. 1 is a schematic isometric view of a package of a continuous strip according to the present invention, the package including five layers or stacks of the strip and being shown with the flexible packaging material omitted for convenience of illustration.

Each stack of the strip comprises a plurality of portions of the strip which are positioned on top of one another. Thus, as shown, in FIG. 4, for example, the portions are folded back and forth at respective end fold lines 25 and 26 to form accordion folds so that the fold lines lie in a common vertical plane defining the ends 18 and 19 of the package. Each portion of the strip lies directly on top of the previous portion so that side edges 27 and 28 of the portions of strip lie directly on top of each other in common vertical planes 27A, 28A as shown in FIG. 1. Of course, other methods of forming a stack of strip material with layered portions could be employed without necessarily folding each strip portion.

The ultimate objective is to obtain a stack wherein each strip portion has a first surface which contacts the first surface of the next adjacent strip above it and a second surface which contacts the second surface of the next adjacent strip below it.

Thus the package is formed by laying or stacking the portions each on top of the next from a bottom portion 29 up to a top portion 30 to form the stack. The package is thus formed from the plurality of stacks each of which has a length equal to that of the other stacks and therefore equal to that of the package. The stacks are formed up to a common height which is therefore equal to the height of the package.

In a preferred embodiment, the package is wrapped by a flexible packaging material preferably of heat sealable non-permeable plastics which encompasses or encases the whole of the package, as indicated at 40. The packaging material includes a base 41 and sides 42 with a top 43 wrapped over the top of the package and heat sealed as indicated at 43A. The sealed package allows air to be extracted from the package and this vacuum action can be used with physical compression from the sides 16 and 17 of the package so as to compress the package, that is the entire top and bottom surfaces of each of the stacks, to a reduced height in a vacuum packaging system. The amount of compression of the stacks can be determined so as to minimize the volume of the package without interfering with the required loft of the product when withdrawn from the package. In this way the package structure avoids the necessity for rigid sides of a box or similar container so the package structure is stable due to the compression of the layers to reduce the height of the stacks and due to the pressure of each layer against the sides of the next adjacent stacks. Depending on the particular strip material, such compression and packaging can form a flexible, resilient, soft stack into a hard, rigid block.

Compression of the package is only practical along the direction D which is at right angles to the surfaces of the portions of the strip. This acts to compress the thickness of the portions so that the dimension of each stack in the direction D is reduced by that compression. Compression along the portions or at right angles to the layers will distort the strip. Mechanical compression therefore of the package in the direction D thus reduces the dimension of the package in that direction allowing the air to be withdrawn from the flexible packaging material 40 causing the packaging material to be pulled down onto the package to maintain it in its compressed condition and to apply pressures tending to hold the stacks in intimate contact. By this, the stacks cooperate to support each other, when there is more than one stack, without the need for rigid intervening support walls.

In the open expanded condition of the packaging material as shown in FIG. 3, the base 41 of the packaging material 40 is shaped and dimensioned so as to be slightly larger than the at rest or uncompressed condition of the package structure itself. In this way the package structure can be readily inserted into the formed plastics packaging material and can remain in place loosely held by the packaging material. During transportation and storage the package structure is preferably in the compressed and vacuumed condition. In this condition the base 41 of the packaging material and the top 43 of the packaging material are both compressed in the direction D so as to form wrinkles or creases 44. When the vacuum is released, however, the expansion of the package from its compressed condition to its normal relaxed condition will cause the creases 44 to be extracted as shown in FIG. 3. Also, in the expanded condition of FIG. 3, there is a slight space 45 between the sides 42 of the packaging material and the sides 16 and 17 of the package structure allowing the strip to be pulled in the unwrapping process from the ends of the stacks without compressing or distorting the end portions 29 and 30.

When wrapped, compressed, sealed and mounted on a transportation pallet 46, the package structure is, as shown in FIGS. 2 and 3, oriented so that the stacks are horizontal. In this orientation, the application of vertical loads onto the package from other packages causes the transfer through the package structure to the pallet 46 without distorting or damaging the strip. This occurs due to the fact that the strip is relatively stiff across its width and, thus, when compressed into the stacks, the strips together form a substantially rigid structure.

This orientation of the package used for unwinding the package is shown in FIG. 3. Thus in FIG. 3 a partial unwinding of the structure is shown in that the top 43 is opened and the leading end 12 of the strip is found and pulled through the opening. By placing the package in this orientation, therefore, each stack in turn can be unwound without the danger of the stack toppling since it is lying on its side supported by the underlying stacks.

Each stacks is connected to the next by a traverse portion of the strip which extends from one stack to the next. Thus the intermediate stacks are each connected so that one end of the strip of that stack is connected to the next adjacent stack on one side and the other end of the strip of that stack is connected to the next adjacent stack on the opposite side. A technique for connecting the strip of each stack to the next stack is shown and described in more detail hereinafter.

As shown in FIG. 4, if desired some of the transverse fold lines can be offset from all or some of the others in a direction longitudinal of the portions. Thus the fold lines 25A are offset inwardly from the plane 25 at one end, and the fold lines 26A are similarly offset from the plane 26. This technique can be used to prevent build-up at the ends of the package when the material being packaged is resistant to folding leaving a fold of increased height.

Figure 5:
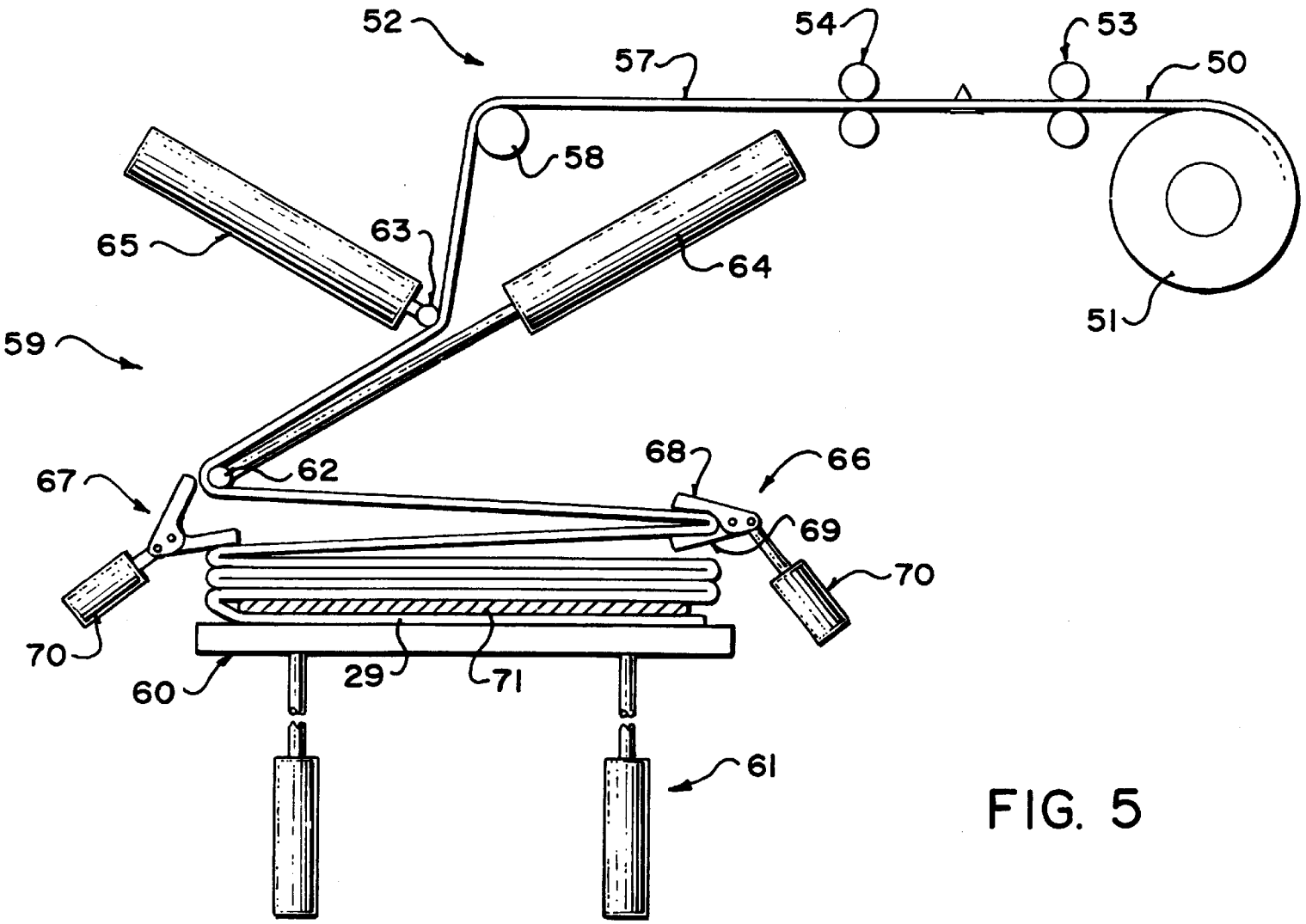
FIG. 5 is an end elevational view of an apparatus and method for use in forming a folded intermediate structure to be used in manufacturing the package of FIG. 1.
Figure 6:
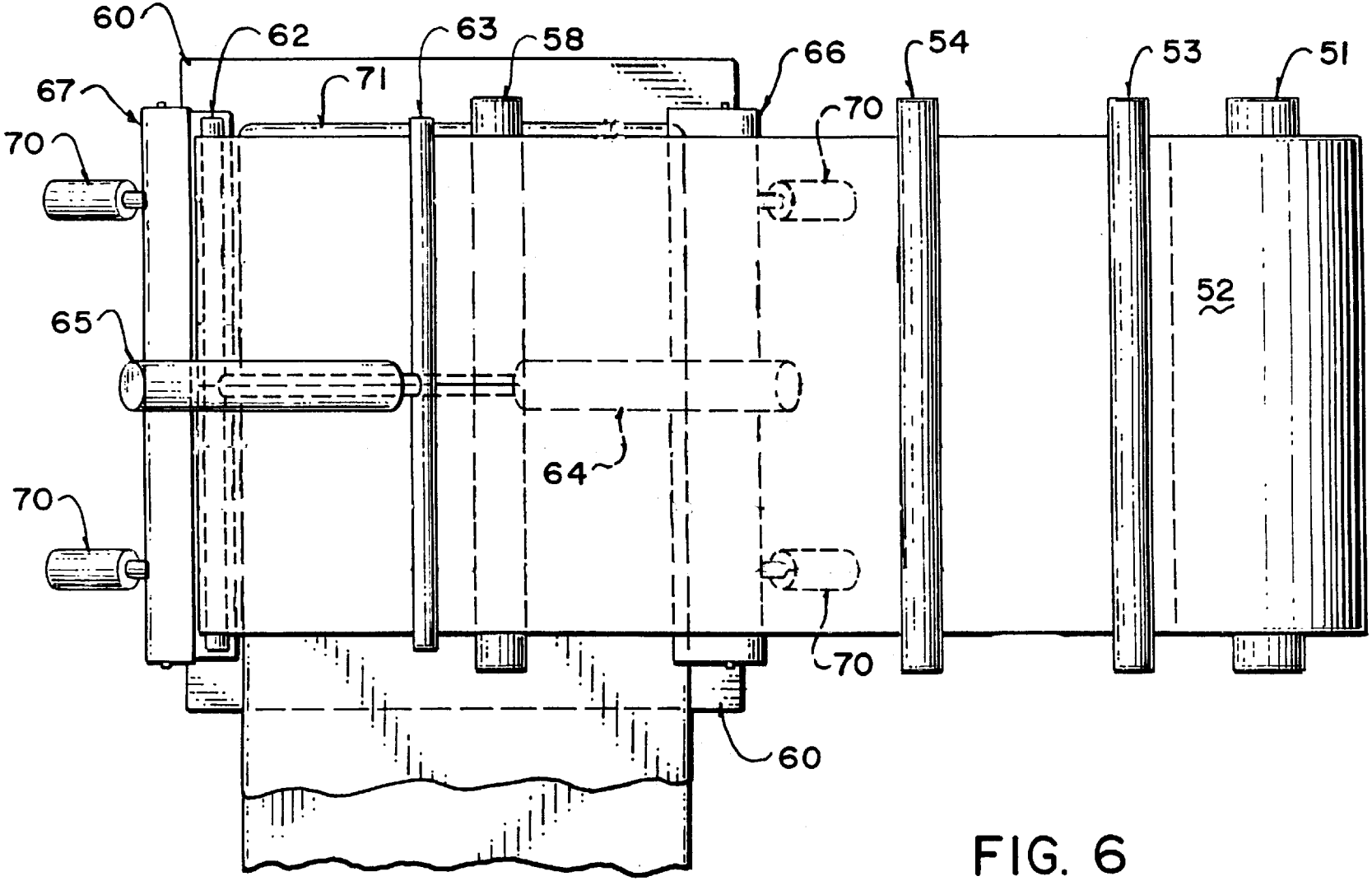
FIG. 6 is a top plan view of the apparatus of FIG. 5.

Turning now to FIGS. 5 and 6, a technique for forming the package structure is shown in more detail. A web 50 is supplied on a master roll 51 and is unwound from the master roll by a feeding and guide system 52 including two nip roller pairs 53 and 54. The web 50 is fed over a guide roller 58 into a folding system generally indicated at 59 located underneath the guide roller 58.

The folding system 59 comprises a support table 60 having a width sufficient to receive the full width of the web 50. The support table 60 has a length sufficient to receive the portions of the webs in the structure as previously described. The table 60 is mounted upon a jacking system 61 (which is shown only schematically) and acts to raise and lower the table so that the table can be gradually lowered as the strips are folded onto the table.

The folding system further includes a pair of folding bars 62 and 63 which act to fold the webs back and forth across the table 60. The folding bar 62 is mounted on an actuating cylinder 64 and similarly the folding bar 63 is mounted on an actuating cylinder 65. In FIG. 5, the folding bar 63 is shown in the retracted position and the folding bar 62 is shown in the extended position. The folding bars move alternately between these positions so that the folding bar 62 is firstly retracted and then the folding bar 63 is extended so as to move the web across the table to form the overlying portions of the web previously described. The folding bars 62 and 63 extend across the full width of the web so as to move the web into the folded positions. The folding bars 62 and 63 may be in the form of rollers or any formation that allows the material to pass over the bar without or with minimal friction while the material is being pushed by the bar to the required position on the table. The mounting system for supporting the cylinders is not shown for convenience of illustration and this will of course be well apparent to one skilled in the art.

The folding system further includes a pair of creasing jaws 66 and 67 each arranged at the end of the stroke of a respective one of the folding bars. The creasing jaws also extend across the full width of the web and comprise a pair of jaw elements 68 and 69 which can be moved from an open position as indicated on the left and a closed creasing position as indicated on the right. The jaws are moved between these positions by an actuating cylinder 70 timed in relation to the operation of the cylinder 64 and 65. In addition to the opening and closing movement, the creasing jaws also move inwardly and outwardly in a horizontal direction relative to the table so as to release each fold or crease line after it is formed to allow that portion of the web and the fold at the end of the portion to be dropped onto the previous portions and to move downwardly with the table 60. Thus as illustrated, the creasing jaw 66 at the completion of the crease moves outwardly away from the crease or fold line and at the same time opens slightly to release the fold between the two portions to drop downwardly onto the underlying portions. The jaws then open and move back inwardly ready to receive the portion of the web wrapped around the folding bar and to grasp those as they are released from the folding bar as shown at the creasing jaw 67 in FIG. 5. This compound motion can be effected by suitable mechanical linkage operated by the actuating cylinder 70, this arrangement again being well apparent to one skilled in this art. Alternatively, or in conjunction with the creasing jaws, a tamper can be used to press on the folded end.

The web is therefore simultaneously laid down in portions folded back and forth or otherwise formed on top of one another in order to provide a continuous web. One or more master rolls may be spliced into the supply with the splice being formed across the width of the web.

Figure 7:
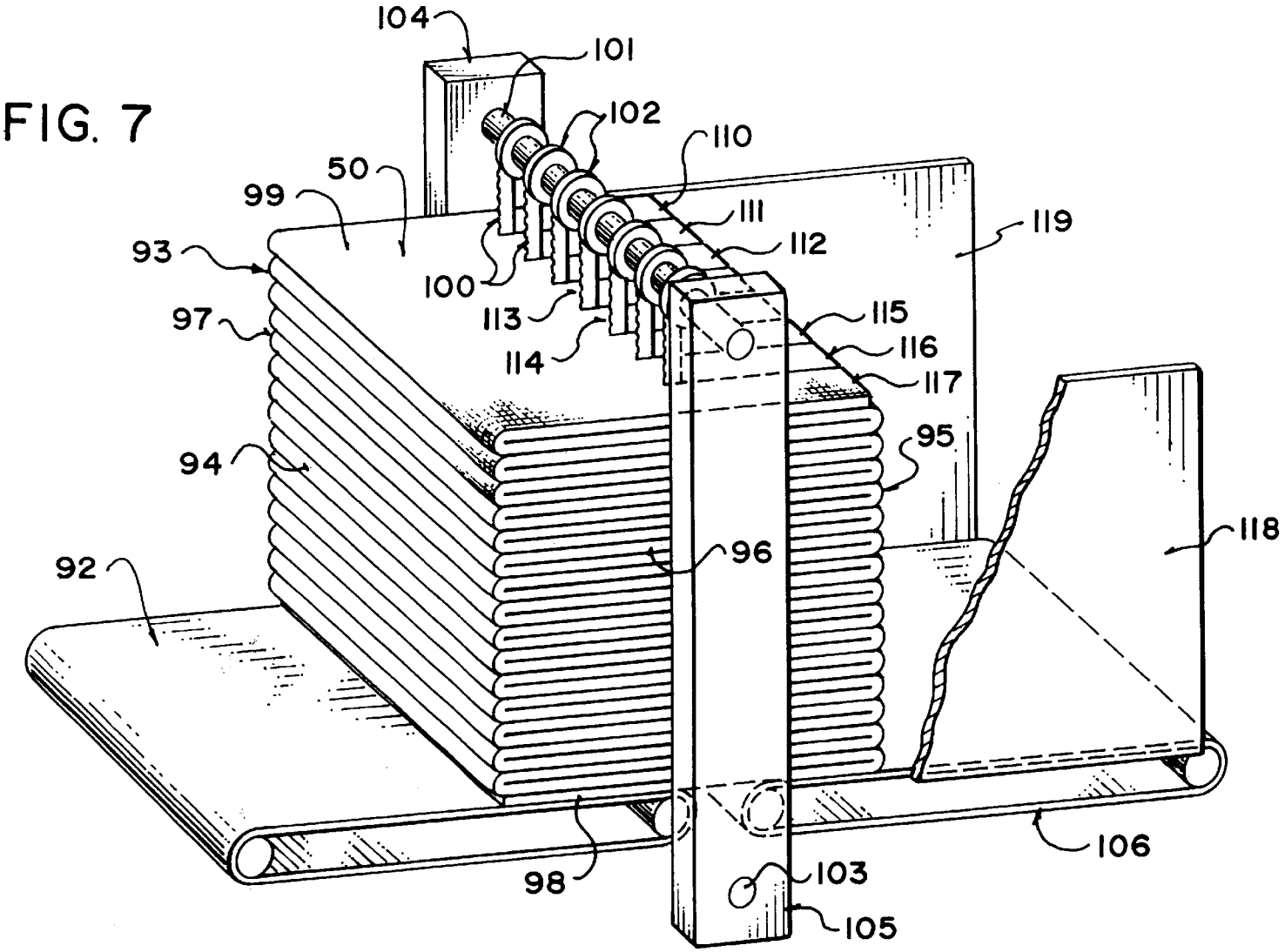
FIG. 7 is an isometric view of an apparatus for cutting the folded intermediate structure manufactured in the method of FIG. 5 for forming the package of FIGS. 1 to 4.

Turning now to FIG. 7, the body formed by the folded web is then transferred from the table 60 onto a belt conveyor 92. The body 93 has the web 50 folded back and forth as shown so as to form on the body ends 94 and 95 containing the fold lines of the web together with sides 96 and 97 which contain the overlying side edges of the portions of the web. A lowermost web portion 98 is at the bottom of the body and an uppermost web portion 99 is at the top of the body in this exemplary arrangement.

A cutting assembly for the body comprises a plurality of band saw blades 100 arranged at spaced positions along a shaft 101. The band saw blades are each mounted on a respective one of a plurality of pulleys 102 so that rotation of the shaft drives the band saw blade along its length. The band saw blades 100 are arranged to stand vertically in parallel vertical planes parallel to the sides 96 and 97 of the body. Each band saw blade 100 has an idler pulley mounted on a shaft 103 underneath the body and at the discharge end of the conveyor 92. The shafts 103 and 101 are mounted on two parallel support towers 104 and 105 at respective sides of the body. A second conveyor 106 is arranged with an upper run lying in a common horizontal plane with the upper run of the conveyor 92 so as to carry the body through the cutting assembly from an initial uncut position on top of the conveyor 92 to a second position on top of a conveyor 106 in which the body has been cut by the band saws to separate the body into a plurality of parallel stacks 110 through 117. Two side guide walls 118 and 119 are provided for engaging the sides 96 and 97 of the body after cutting to maintain the integrity of the body as it is carried through the cutting station and after cutting is complete while the body is standing on the conveyor 106.

The band saw blade 100 is of a type known as a razor knife band which is intended to effect a cutting action without removing material from the body as the cutting occurs. The razor knife band is of a type having a scalloped front edge chamfered on both sides of the front edge. The fact that the material can be slightly distorted allows the band blade to slide through the material without removing material from the body. The blade is arranged so that it can accommodate the significant length between the shafts 101 and 103 without significantly distorting from the straight line therebetween. An increased width of the blade may therefore be necessary in view of the relatively long length of the blade to provide a cutting action of up to four feet of the height of the body. Of course, any known suitable arrangement for forming a sheet into strips can be utilized.

The individual stacks for a package structure of this type can therefore be formed in different ways and can be assembled into a package structure.

The technique using the cutting action through the body is particularly effective in that it ensures that the stacks are entirely separate without any interleaving and allows the folding action to be effected more rapidly.

Figure 12:
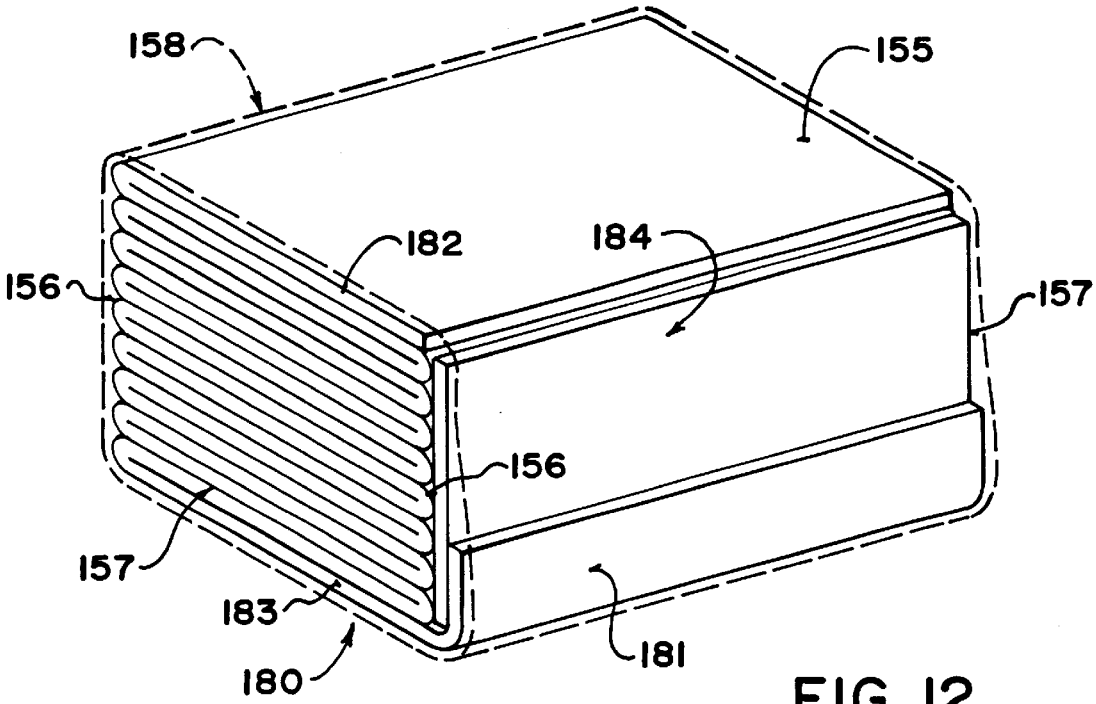
FIG. 12 is an isometric view of a compressed wrapped package in which the package body is formed from a single strip or web.

The package body thus formed by the methods disclosed above can be of the type including a single stack containing an un-sliced strip or web as shown in FIG. 12 described hereinafter or it can be of the type having a plurality of slit stacks as produced by the method of FIG. 7 and shown in FIGS. 8 to 11 described hereinafter. As shown in FIGS. 8 to 11, the stacks are not spliced together in the package but can be spliced together after the package is opened at the end use location or may be used without splicing. In FIGS. 1 to 4, the spliced connections 90, 91 between the stacks are shown.

Figure 8:
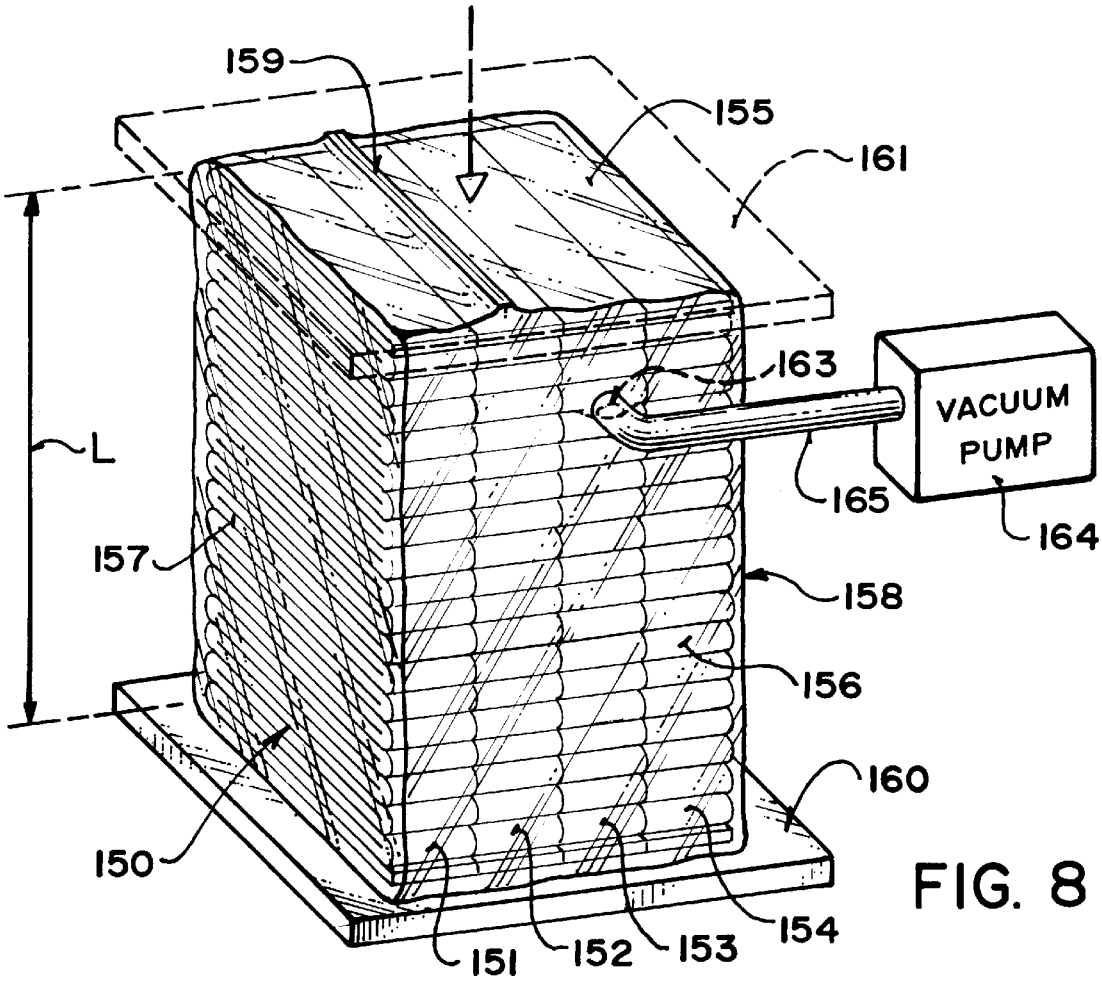
FIG. 8 is an isometric view showing a package body similar to that of FIGS. 1 to 4 and including the method of compressing the package body in a closed bag.

In FIG. 8 is shown the package structure after cutting in the method step shown in FIG. 7 so that the package body generally indicated at 150 includes a plurality of stacks 151, 152, 153 and 154. Each stack is formed by the strip which is folded back and forth as previously described. The package body and the stacks, thus have a top and bottom 155 respectively of the structure as shown, ends 156 which contain the fold lines and sides 157 which are parallel to the side edges of the strips.

The package body is wrapped by an enclosing bag 158 of a flexible sealable plastics material. The bag has a length L which is sufficient to receive the whole of the package body in a non-compressed condition or an initial rest condition. The bag is shaped so that it has sides closely conforming to the ends 156 and the sides 157. The bag has a bottom underlying the bottom 155. The bag has top portions which are folded inwardly and connected at a sealed or closure line 159 so that the bag is substantially fully closed around the package.

The package body in the bag is then compressed between a base plate 160 and a top plate 161, that are movable with respect to each other. The top plate engages the top of the package body and thus the entire top surface of each stack and the top surface of the bag.

The top plate 161 is moved downwardly thus mechanically compressing the package body downwardly. At the same time the bag is squeezed downwardly so that its length is reduced to a length L1 as the height of the package body is reduced. The bag 158 thus forms a series of creases 162 as it is compressed downwardly. Of course, either top plate or bottom plate or both plates can be moved to effect compression.

The amount of compression depends upon the type of material in the strip. Some materials can accommodate a significant compression factor down to a compressed height L1 which is of the order of 25% or even less of the original condition L. Other materials can accommodate only a reduced amount of compression. The amount of compression which can be accommodated depends upon the amount of loft in the material as supplied, the ability of the material to rebound when the compression is released, the amount of loft required in the material when unwrapped from the package for supply to an end use machine, and the possibility of damaging the material at the fold lines if these are creased too vigorously. As the strip in many end uses is of a fibrous nature containing air between the interstices of the fibers, the compression of the stack can be effected until each strip portion is reduced in thickness by the expulsion of air from the interstices.

Generally fold lines transverse to the strip can be accommodated, whereas any creases longitudinally of the strip can be problematic. Longitudinal creases can effect the integrity of the material and cause manufacturing and feeding problems. The present method in which the strip is laid in portions which directly overlie one another avoids the formation of longitudinal creases in the strip.

During the compression, air from stacks and particularly that from the interstices in the fibrous strip portions within the closed bag is exhausted through an opening 163. The opening is relatively small and simply allows air to gradually escape as the compression is gradually effected from initial rest condition to the compressed condition. A vacuum pump 164 may be attached to the opening 163 by a duct 165. The vacuum pump has a low vacuum pressure of the order of 17 inches WG. The hole 163 is relatively small and can be of the order of ½" diameter. The vacuum pump simply assists in the escape of the air so that there is less pressure within the bag due to the compression of air within the bag which is squeezed from the package body. The use of the vacuum pump therefore can allow the compression to be effected more quickly without the danger of excess pressure in the air inside the bag causing rupture of the bag.

When the compression is effected down to the predetermined required height of the package body and the remaining air in the bag removed at this compressed condition, the hole 163 is sealed as indicated at 166 by pinching the bag together at the hole and effecting a heat sealing of the bag. It will be appreciated that the bag is relatively creased by the creases 162 in the area of the hole and therefore excess bag material is available for closing the hole at the crease and for effecting the heat seal.

It is not intended that the vacuum be applied sufficiently to extract significantly more air than that which is expelled by the compression action and thus to apply additional compression. Any such withdrawal of air beyond the mechanically compressed condition causes the bag to be pulled in at all sides so that excessive compression is applied to the sides 156 and 157 of the package body. In this embodiment, it is intended that the compression be effected substantially only in the direction at right angles to the ends of the package body. The use of mechanical compression followed by the sealing of the closed bag ensures that the compression is effected only in the intended direction and that there is little or no compression in the directions at right angles to the sides. Of course, it may be desirable for certain materials to effect compression at every side in which case additional vacuum can be applied.

There is a tendency for the material to expand as a spring in the direction opposite to the compression so that the material of the package body is urged to expand in that direction. This is held against that expansion by the fact that the bag is closed but no air can enter to allow the bag to expand. The spring effect in the compression direction will cause a slight pressure against the sides of the package pulling the bag against the sides and thus holding the stacks closely together and the package body integral and intact. However the spring force is insufficient to provide significant distortion of the package body in these directions.

Figure 9:
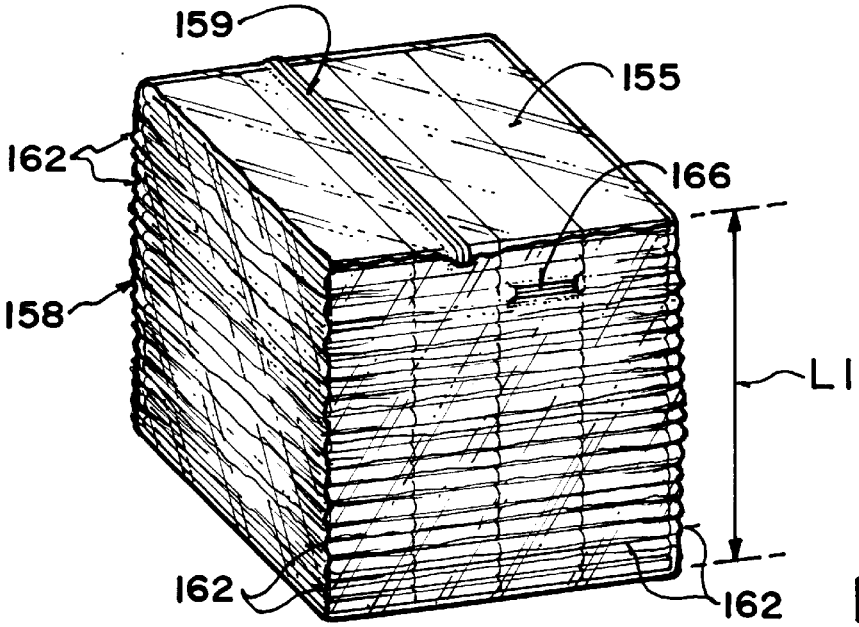
FIG. 9 is an isometric view of the package of FIG. 8 after compression and sealing of the closed bag.

The package body after compression within the closed bag and after sealing of the bag is basically a stable structure as shown in FIG. 9. However, any penetration of the bag allowing the ingress of air will allow the spring effect of the package body to cause the package body to expand back to its initial condition. As the bag has the length of the package body in the expanded condition, it will not restrict this expansion.

Figure 10:
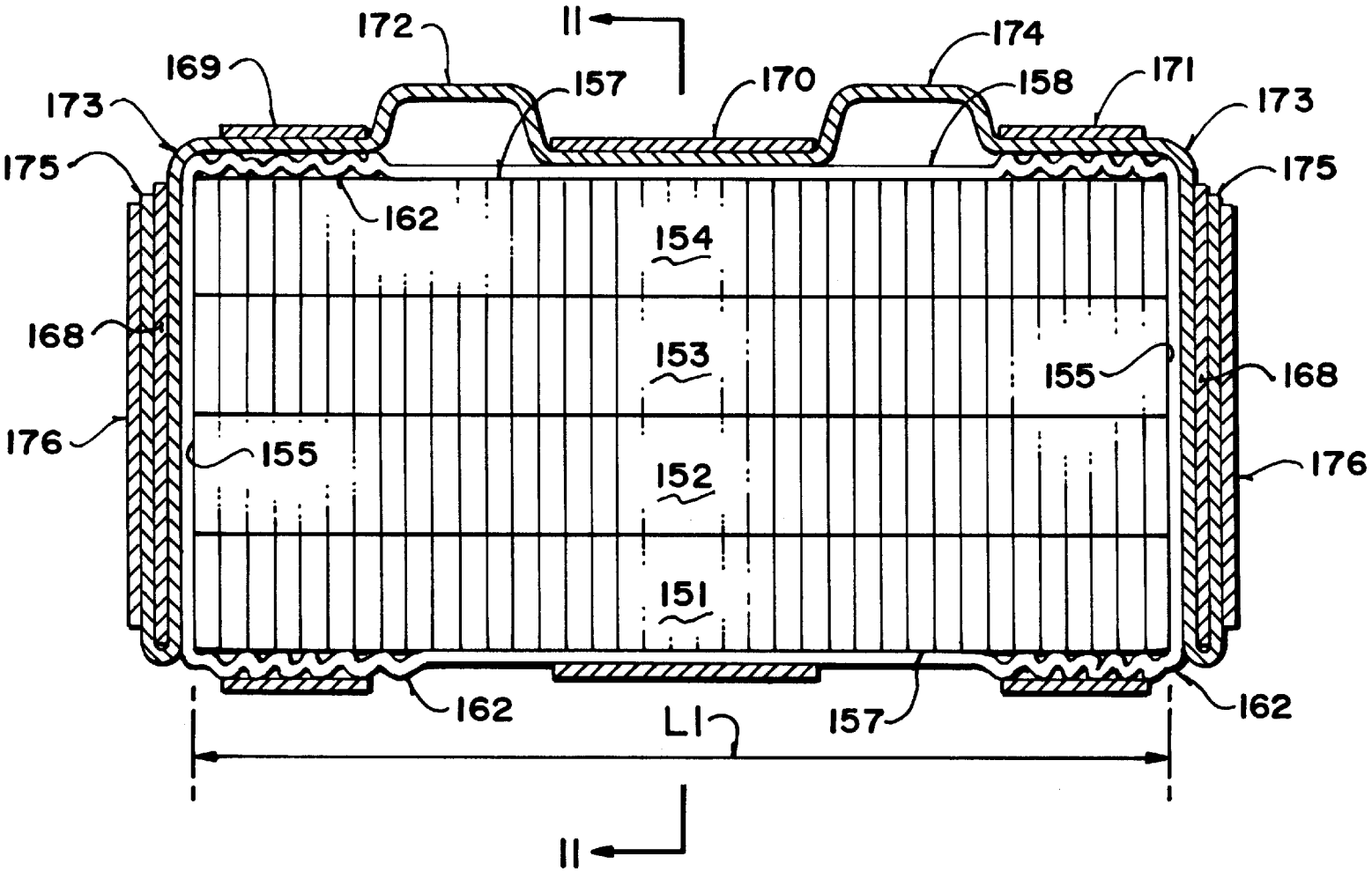
FIG. 10 is a cross-sectional view of the package of FIG. 9 after wrapping with an additional layer around the closed bag, the cross-section being taken along the lines 10—10 of FIG. 11.
Figure 11:
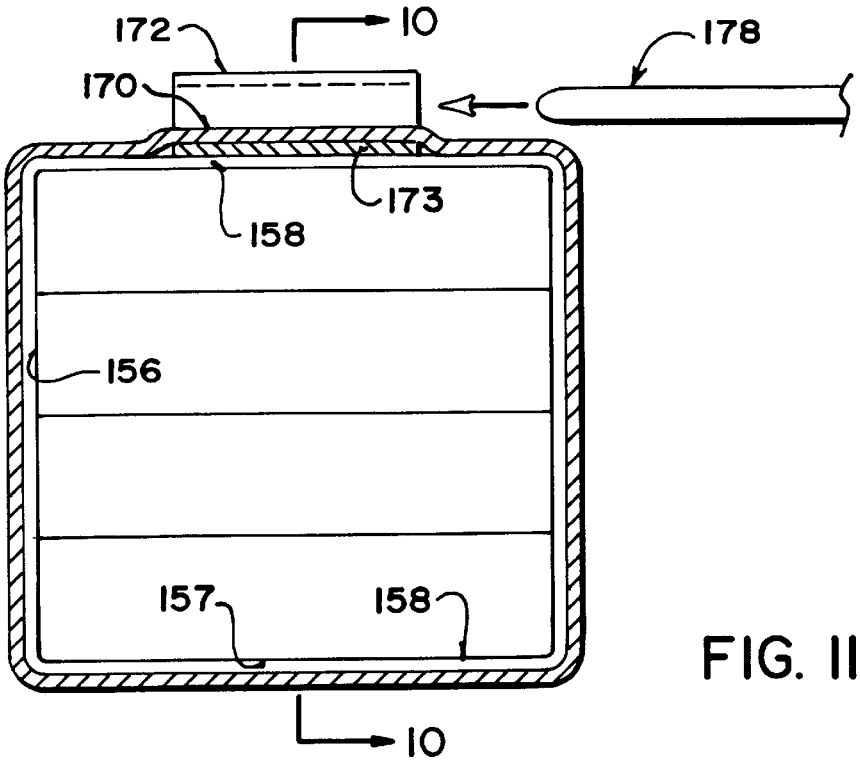
FIG. 11 is a cross-sectional view taken along the lines 11—11 of FIG. 10.

In FIG. 10 it will be noted that the package body is turned so that the stacks 151, 152, 153 and 154 are turned on their side so that the package body is lying on one of the second sides 157.

In order to prevent inadvertent expansion of the package body due to penetration of the bag 158, the bag can be wrapped around the ends 155 and the first sides 156 by a first layer 168 with a wrapping material. The wrapping material is generally of the type which can be slightly stretched as it is pulled in strip form around the package and is wrapped around several times with the stretching action causing adherence between the various layers of the wrapping material to hold the wrapping material in place.

The package body and the bag is also wrapped in a direction opposite to the layer 168 to form a second layer 169 which is wrapped around the sides 156 and 157 of the package body.

In order to provide lifting handles 172, 174 for the package structure, a strap 173 is engaged around at least part of the package body with a portion passing across the top surface of the package body defined by the side 157. The top wrapping 169 holds the strap down against the bag 158 except in the place of two loop handles 172, 174. The top wrapping is provided by separate sections 169, 170 and 171 which are arranged at the ends at an intermediate section thus forming the loops 172 and 174 which are exposed between the wrappings.

Ends 175 of the strap 173 are held in place by an additional end wrapping layer 176. Thus the strap 173 includes a first portion extending down the end 155 of the package body and a second portion extending back up the same end. These portions are then wrapped by the wrappings 168 and 176 to hold the end in place. The remainder of the strap then extends across the top of the package body to form loop handles 172 and 174 by which the package body can be lifted using a conventional fork lift system schematically indicated at 178.

The additional wrappings thus hold the package body in the compressed condition in the event of penetration of the bag allowing air to enter the bag. However this type of wrapping is optional and may not be preferred in certain cases since it applies a constant tension from the wrapping inwardly onto the package body which could tend to distort the package body toward a spherical shape from its initial rectangular shape with the possibility of compressing and distorting the strip in the individual layers. The use of the sealed bag is much more effective at holding the package body in its preferred rectangular body shape in view of the mechanical compression which initially avoids applying any compression to the sides.

Figure 13:
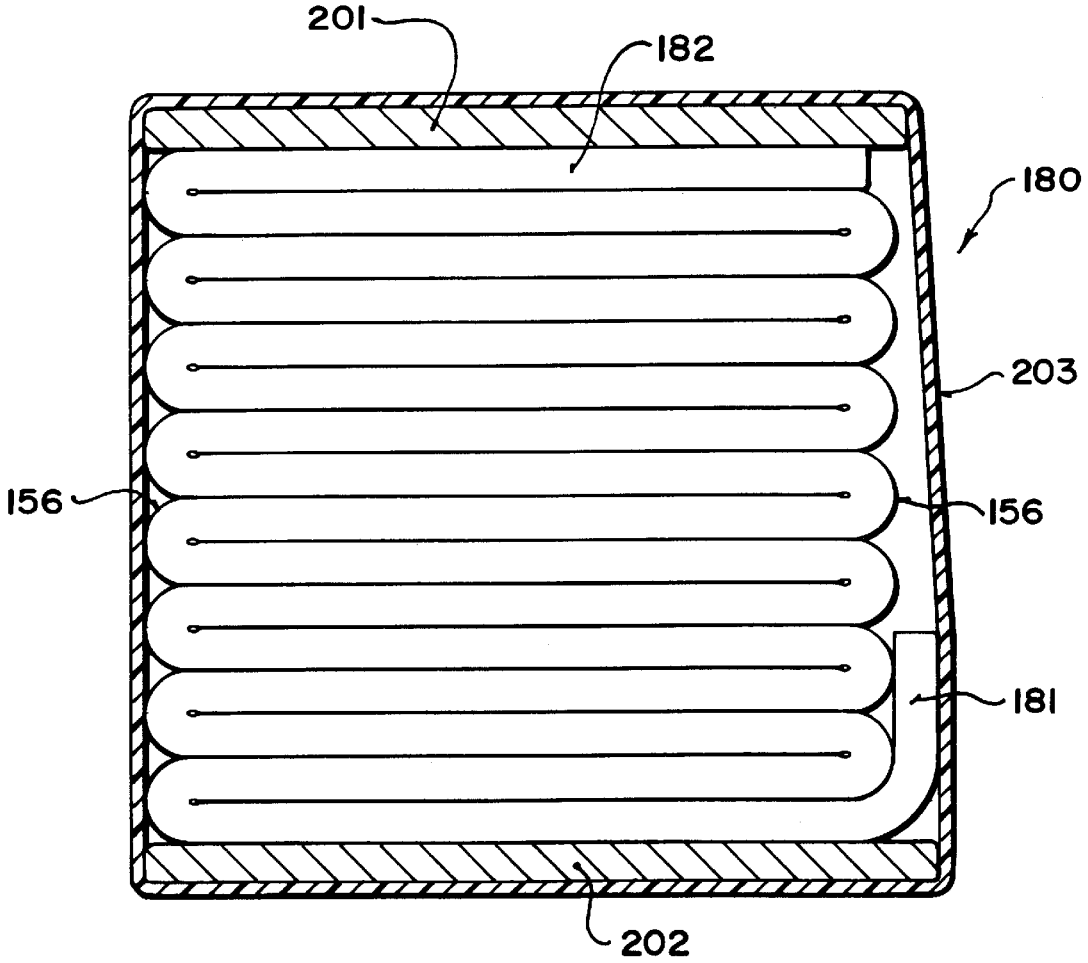
FIG. 13 is a schematic cross-sectional illustration of a package having the structure of FIG. 8 which is packaged using rigid headers at the top and bottom and wrapped using conventional wrapping materials.

Turning now to FIGS. 12 and 13, there is shown a package body 180 formed from a single strip or web of sheet material so that side edges 181 of the strip define the sides 157 of the package body and the fold lines of the strip define the ends 156 of the package body. There is therefore only a single stack as opposed to the multiple stacks of the previously shown embodiments.

This package body is then wrapped by a closed bag 158 as previously described and compressed in the direction of the ends 155 as previously described but shown only schematically to reduce the height of the package body by compression of the package body and to form creases in the bag. The same mechanical compression and vacuum process is provided so that the bag is then sealed to hold the package body in its compressed condition. The same wrapping processes shown in FIGS. 10 and 11 can also be applied to the package structure of FIG. 12. As shown and described hereinbefore, a tail portion 181 is provided at the bottom of the stack for connection to a top strip portion 182 of another similar stack of the same strip. In the embodiments of FIGS. 7, 12 and 13 where the stack is vertical with one end of the stack forming the bottom strip portion, the tail portion 181 at the bottom end is exposed from the bottom strip portion 183 beyond one end 156 of the stack so as to lie along the fold lines at the end. The tail extends outwardly from the end of the strip at the bottom (or top) of the stack. This makes the tail accessible for splicing. The top strip portion can be unfolded for splicing and therefore there is no need of a special tail portion.

It will be appreciated therefore that the stack with the tail portion accessible at the bottom end by way of the tail portion 181 and accessible at the top of the stack by way of the exposed top strip portion 182 can form part of a package structure with only a single stack or can be arranged alongside other stacks to form a multi-stack structure. The splicing in the multi-stack structure can provide connection from each stack to a next adjacent stack or can provide connection to a stack of another package or an end use machine. Of course in the single stack structure as shown in FIG. 12, the tail provides the possibility of splicing to another package.

In the embodiments illustrated herein, the strips are slit or cut in straight lines so that the side edges of the strips are parallel and are parallel to the sides of the package structure when completed. The strips also lie immediately adjacent such that the whole of the side edges of the strips are in contact with the strips of the next adjacent layer. However in other embodiments, not shown, the side edges of the strips are not necessarily straight but are cut in curved lines so that the width of the strips varies along the length of the strips. Preferably in this arrangement, the next adjacent strip is arranged to have a wider part at the narrower part of the strip so that the strips are immediately adjacent with no intervening waste. However such strips are longitudinally offset. Also in this arrangement it will be appreciated that the side edges of the strips do not lie in a common plane even though they lie in aligned arrangement. Each line which is right angles to the surface of the strips and contains the aligned edges of the strips is however parallel to the second ends of the package. In the simultaneous cutting action shown in FIG. 7, the cutting assembly can be traversed side to side as it moves through the package to effect the required changing shape of the side edges of the strips.

In all embodiments, the compressed stack is not contained within a rigid container or cassette. So, the tail is exposed and may require protection. In the arrangements using a vacuum package of the stack or stacks within a bag, the tail is preferably protected from being compressed and creased against the end of the stack at the fold lines by an intervening protective sheet 184, seen in FIG. 12. The tail can also be folded or inserted into a container to ensure that it is protected against damage.

In FIG. 13 is shown a modified arrangement of the stack 180 of FIG. 12 in which the stack is packaged not in a vacuum bag of the type previously described but instead in an alternative form of packaging system. Thus the stack 180 includes the folded web defining the structure as previously described including the top strip portion 182 and the tail 181.

The length of the tail along the end 156 is shown as being relatively short since the minimum length necessary is that which is sufficient merely to allow connection to an unfolded part of the top of the next stack. However the tail 181 can be of increased length and can be folded back on itself and contained within a protective pocket as described hereinafter.

In FIG. 13 the package structure in its rectangular shape is maintained using rectangular rigid flat header plates to 201 and 202 at the top and bottom respectively of the stack structure. The rigid header plates can be formed of any suitable material, such as plywood, plastic or metal, and are held in place by a plurality of surrounding straps 203 of conventional strapping material. This form of package can be manufactured more cheaply using simple recyclable header plates. This type of packaging arrangement is particularly suitable for the single stack structure but can be used also with the multiple stack structure. Once the compression is effected between the header plates, there is no tendency for the stacks to collapse sideways in view of the fact that the compression forms a rigid structure. In the arrangement shown in FIG. 13, the tail 181 is not compressed vigorously against the end 156 and therefore there is no necessity for the protective sheet 184. Thus the header plates project out slightly beyond the end 156 of the package at the tail 181 and thus hold the strapping 203 spaced away from the tail leaving the tail relatively loose.

This form of packaging is thus more simple, less expensive and recyclable but does not provide the enclosed protection for the product which is necessary in many circumstances.

Figure 14:
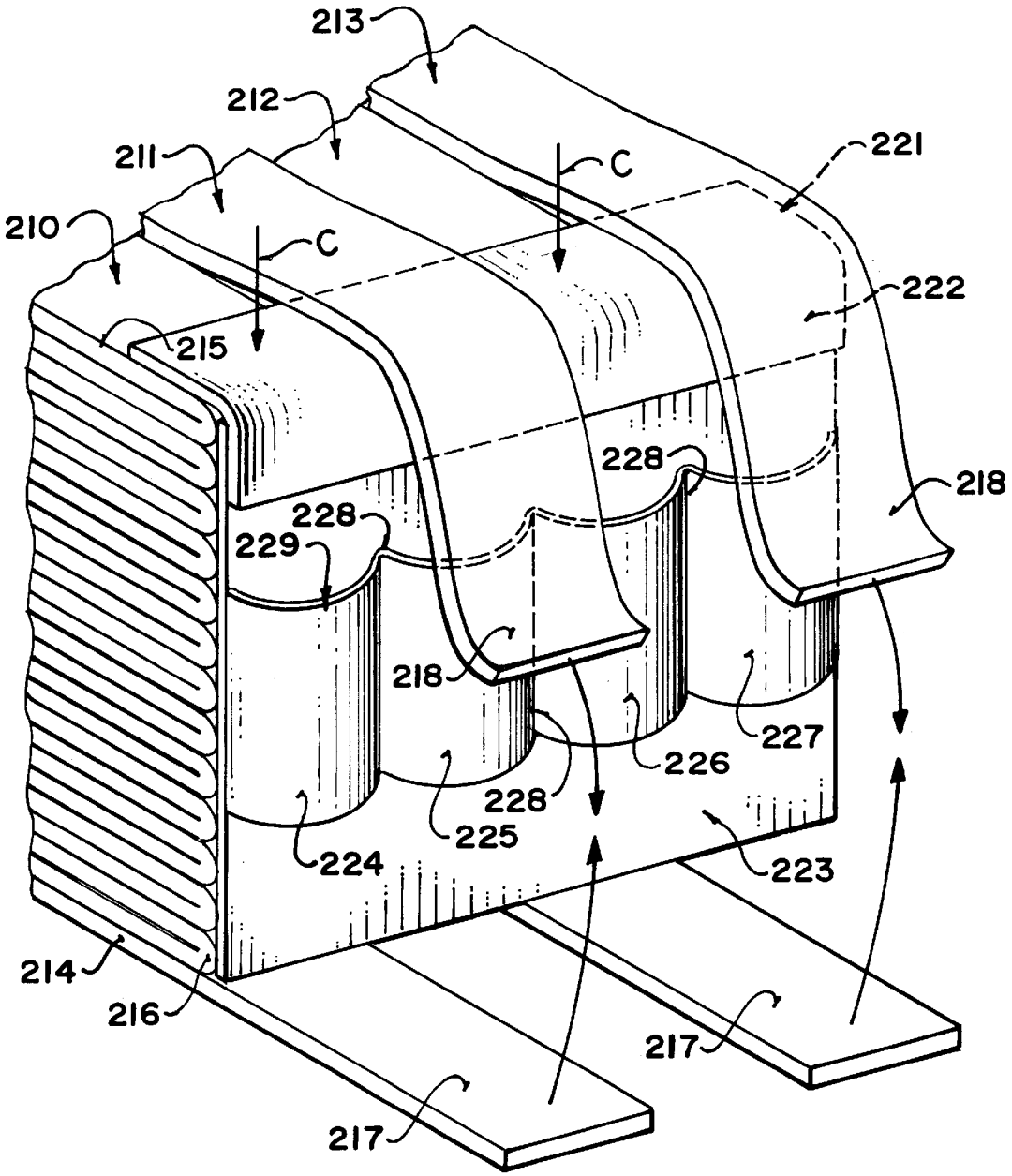
FIG. 14 is an isometric view of a package including a plurality of stacks and showing the splice tails ready for splicing and folding into a splice connection container at one end of the package.
Figure 15:
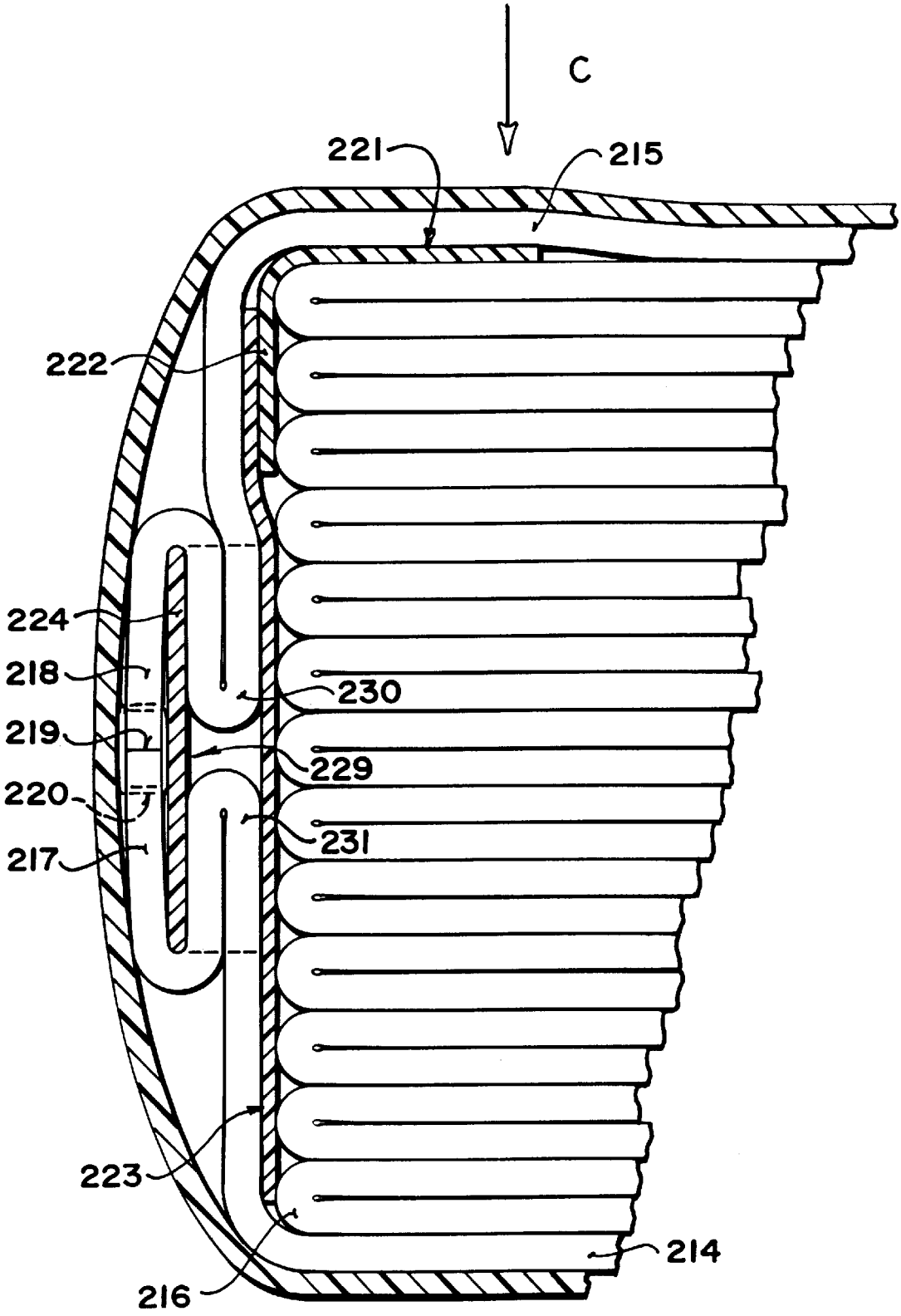
FIG. 15 is a cross-sectional view through one end of the package of FIG. 14 showing the splice connections completed and folded into the container.

Turning therefore to FIGS. 14 and 15, details are shown of the protection of the tail by which it is retained within a storage sleeve and separated by a separation sheet from the fold lines, while the package is compressed by the vacuum bag. These details are shown in conjunction with the multi-stack package of FIG. 7. However the protection of the tail can also be applied to the arrangement shown herein where there is a single stack.

In FIGS. 14 and 15 a package is shown containing a plurality of stacks 210, 211, 212 and 213. These stacks are formed as previously described and are arranged in the upright orientation so as to form the strip portions from a bottom strip portion 214 to a top strip portion 215.

At both the top and bottom of each stack is provided a tail portion 217, 218 which extends out beyond the end of the stack. In FIG. 14, one end of the stack only is shown and it will be appreciated that there is an opposed end which is symmetrical.

The stacks are arranged alternately so that the tails 217, 218 of the stacks 210, 212 are identical and the tails 217, 218 of the stacks 211 and 213 are identical. More particularly the bottom strip portion 214 of the stack 210 includes a tail portion 217 which extends outwardly beyond the end 216. The stack 211 has a tail portion 218 attached to or integral with the top strip portion 215 which extends also outwardly beyond the end 216. It will be appreciated from the symmetry of the structure that a bottom tail portion 217 is provided on the stack 212 and a top tail portion 218 is provided on the stack 213. Also it will be appreciated that the structure alternates in that the bottom tail portion of the stack 211 is arranged at the opposite end of the stack and the top tail portion of the stack 210 is arranged also at the opposite end of the stack.

It will be appreciated that four stacks are shown as merely an example and in most cases the number of stacks will be significantly greater, or even just a single stack, but this can of course vary depending upon requirements.

As described in more detail in application Ser. No. 08/948,256 filed Oct. 9, 1997 mentioned above, the tail 217 of the stack 210 is spliced to the tail 218 of the stack 211. Symmetrically, the tail 217 of the stack 212 is spliced to the tail 218 of the stack 213. At the opposite end symmetrical splicing occurs from the bottom tail of the stack 211 to the top tail of the stack 212. In this way the strip is continuous through the complete package from a lead end at the top of the stack 210 to a trailing end at the bottom of the stack 213.

As shown in FIG. 15, the splicing is effected at a butt joint 219 which is maintained in butting condition by stitches 220, for example. A variety of connecting methods may be used including heat sealing, pressure or adhesive.

The splicing is effected while the stacks remain at their initial uncompressed condition so that the length of the splice connecting portion defined by the butting tails 217, 218 is equal in length to the height of the stacks.

In FIG. 14, compression is indicated schematically at C by which the stacks are compressed to a compressed height as previously described. In this condition, the length of the connecting portions is longer than the height of the stacks. So, it is necessary to take up the excess length and ensure that the excess length portion is supported and contained to prevent damage or creasing during the compression from the vacuum bag.

This protection is obtained by an initial protection or slip sheet 221 formed of a paper or plastics material which is laid over the top strip portions adjacent the end 216 with a depending front portion 222 of the sheet depending upon the end 216. As seen in FIG. 14, sheet 221 does not have to cover the entire top of the stacks but should at least cover the corner. It will be appreciated that the sheet 221 is inserted into place prior to compression so that it is received underneath a compression plate (not shown) effecting the compression C. The tail portions 218 from the top strip portions are arranged to be draped over the slip sheet 221. Any suitable material that allows the package to be compressed with preferably low friction can be used.

After compressing is complete to the required height of the stacks, an end protection sheet 223 is inserted against the end 216 of the package. The end protection sheet 223 comprises a rectangular sheet portion of a plastics material, for example, which has a height equal to the compressed height of the stack and a width equal to the total width of the stacks so as to cover the end 216. A top edge of the sheet 223 is applied along the depending portion 222 so as to overlie or be tucked under the depending portion. The tails 218 extend over the sheet 223 and the depending portion 222.

The sheet 223 is separate from the sheet 221 so that the sheet 221 can be applied before compression and the sheet 223 can be applied after compression when it can be properly aligned and arranged on the end face 216. Sheet 223 can overlap as shown in FIG. 15 or underlie as show in FIG. 14, sheet 221. The sheet 223 carries a plurality of vertical sleeves 224, 225, 226 and 227 which are formed by laying a sheet 229 of similar plastics material across the sheet 223 and by heat sealing the top sheet 229 to the underlying sheet 223 along vertical lines 228 which define side edges of the sleeves or pockets. Each sleeve is therefore open at the top and bottom. Each sleeve has a width equal to the width of a stack. The front sheet 229 defining the sleeves has a height less than the height of the back sheet 223 so that the open top and open bottom of the pockets are spaced from the top and bottom edges of the sheet 223. Alternatively, the sleeve can be sealed at the ends of the package only, with no intervening vertical lines to form one large pocket or strap.

Thus as shown in FIG. 15, one portion 230 of the connecting portion is pushed into the top of the pocket 224 and one portion 231 is pushed into the bottom of the pocket 224 so as to fold these portions and maintain them protected and contained within the pocket. The height of the pocket is arranged so that the inserted portions 230 and 231 can neatly accommodate or take up the complete length of the of the connecting portion with no excess that can be crumpled during packaging and transport.

The sheet 223 is thus located between the connecting portions and the end 216 of the stacks so that when compression occurs, the connecting portion is not creased or crinkled against the fold lines. The sheet does not need to be rigid but can be simply a plastic sheet. As the sheet is applied after compression has occurred in a direction C, the sheet lies over any valleys formed at the fold line and therefore tends not to be pulled into the valley and securely prevents the connecting portion from being pushed into those valleys. Similarly the front sheet 229 defining the pocket 224 also protects those portions of the connecting portion which are in front of that sheet and prevents them from being crushed into the folded parts of the connecting portion. The sheets thus form slip sheets allowing sliding of the portions 230 and 231 out of the pocket as the package re-expands when the bag has been opened.

As there only two connecting portions at the end 216, only two of the pockets are used to receive the connecting portions. A similar sheet construction is arranged at the other end of the package for receiving the connecting portions at the other end in a symmetrical manner to that shown in FIGS. 14 and 15.

Thus the tail portions or connecting portions necessary for connecting of one stack to the next are properly protected during the compressed condition for transportation and storage so that these tails or connecting portions are held against damage during this period. The sheets 221 and 223 and 229 act as slip sheets to allow the sliding of the connecting portion and if necessary a part of the top strip portions during expansion of the package when the connecting portion needs to unfurl to match the height of the package.

Thus the complete length of the strip, including the connecting portion and the butt splice, can be used in subsequent processing without necessity for culling or extraction of unusable parts of the strip.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. A package comprising:

at least one stack of a strip of material;

the strip having a first side edge, a second side edge, a first surface and a second surface;

in said at least one stack the strip being repeatedly folded back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of the at least one stack and a plurality of second fold lines at an opposed end of the at least one stack;

the strip portions being arranged such that the first surface of each strip portion lies in contact with the first surface of one next adjacent strip portion and such that the second surface of each strip portion lies in contact with the second surface of the other next adjacent strip portion;

the strip portions being arranged with the first side edges thereof lying on top of and generally aligned with the first side edges of others of the strip portions of the stack and with the second side edges thereof lying on top of and generally aligned with the second side edges of others of the strip portions;

the strip portions being arranged with the first and second surfaces thereof generally parallel to a top surface and bottom surface of the at least one stack;

the at least one stack being substantially upright and having a splice tail portion of the strip extending from a bottom strip portion and extending beyond an end of the at least one stack so as to be accessible for splicing;

wherein the entire top surface and the entire bottom surface of the that least one stack is compressed from an external force in a direction at right angles to the top surface and the bottom surface of the at least one stack, and the at least one stack is engaged by packaging which maintains the compression.

2. The package according to claim 1 wherein the packaging material comprises a closed bag surrounding the package from which air has been withdrawn and which is sealed against ingress of air.

3. The package according to claim 1 wherein the packaging comprises two rigid header plates, each engaging a respective one of a top surface and a bottom surface of the package and each applying pressure thereto for maintaining the compression.

4. The package according to claim 1 wherein when the package is maintained compressed in a direction at right angles to the strip portions of the at least one stack, a rigid free standing package structure without rigid container walls is formed.

5. A method of forming a package comprising:

providing at least one stack of strip material by folding the strip repeatedly back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of the at least one stack and a plurality of second fold lines at an opposed end of the at least one stack;

arranging the strip portions such that the first surface of each strip portion lies in contact with the first surface of one next adjacent strip portion and such that the second surface of each strip portion lies in contact with the second surface of the other next adjacent strip portion;

arranging the strip portions with the first side edges thereof lying on top of and aligned with the first side edges of others of the strip portions of the stack and with the second side edges thereof lying on top of and aligned with the second side edges of others of the strip portions;

arranging the strip portions with the first and second surfaces thereof generally parallel to a top surface and bottom surface of the at least one stack;

arranging the at least one stack substantially upright and providing a splice tail portion of the strip extending from a bottom strip portion beyond an end of the at least one stack so as to be accessible for splicing;

compressing the entire top surface and the entire bottom surface of the at least one stack with an external force in a direction at right angles to the top surface and the bottom surface of the at least one stack; and engaging the at least one stack by packaging to maintain the compression.

6. The method according to claim 5 wherein compressing the stacks in a direction at right angles to the strip portions of the at least one stack forms a rigid free standing package structure without rigid container walls.

7. A package comprising:

at least one stack of a strip of fibrous material;

the strip having a first side edge, a second side edge, a first surface and a second surface;

in said at least one stack the strip being repeatedly folded back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold lines the strip portions forming a plurality of first fold lines at one end of the at least one stack and a plurality of second fold lines at an opposed end of the at least one stack;

the strip portions being arranged such that the first surface of each strip portion lies in contact with the first surface of one next adjacent strip portion and such that the second surface of each strip portion lies in contact with the second surface of the other next adjacent strip portion;

the strip portions being arranged with the first side edges thereof lying on top of and generally aligned with the first side edges of others of the strip portions of the stack and with the second side edges thereof lying on top of and generally aligned with the second side edges of others of the strip portions;

the strip portions being arranged with the first and second surfaces thereof generally parallel to a top surface and bottom surface of the at least one stack;

the at least one stack being substantially upright and having a splice tail portion of the strip extending from a bottom strip portion and extending beyond an end of the at least one stack so as to be accessible for splicing;

wherein the entire top surface and the entire bottom surface of the at least one stack is compressed from an external force in a direction at right angles to the top surface and the bottom surface of the at least one stack, and the at least one stack is engaged by packaging which maintains the compression;

wherein each strip portion is compressed by expelling air from interstices between the fibers and the thickness of each strip portion of said at least one stack is reduced by the external compression force.

8. A package comprising:

at least one stack of a strip of fibrous material;

the strip having a first side edge, a second side edge, a first surface and a second surface;

in said at least one stack the strip being repeatedly folded back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of tire at least one stack and a plurality of second fold lines at an opposed end of the at least one stack;

the strip portions being arranged such that the first surface of each strip portion lies in contact with the first surface of one next adjacent strip portion and such that the second surface of each strip portion lies in contact with the second surface of the other next adjacent strip portion;

the strip portions being arranged with the first side edges thereof lying on top of and generally aligned with the first side edges of others of the strip portions of the stack and with the second side edges thereof lying on top of and generally aligned with the second side edges of others of the strip portions;

the strip portions being arranged with the first and second surfaces thereof generally parallel to a top surface and bottom surface of the at least one stack;

the at least one stack being substantially upright and having a splice tail portion of the strip extending from a bottom strip portion and extending beyond an end of the at least one stack so as to, be accessible for splicing;

wherein the entire top surface and the entire bottom surface of the at least one stack is compressed from an external force in a direction at right angles to the top surface and the bottom surface of the at least one stack, and the at least one stack is engaged by packaging which maintains the compression;

wherein each strip portion is compressed by expelling air from interstices between the fibers.

9. A package comprising:

at least one stack of a strip of material;

the strip having a first side edge, a second side edge, a first surface and a second surface;

in said at least one stack the strip being repeatedly folded back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of the at least one stack and a plurality of second fold lines at an opposed end of the at least one stack;

the strip portions being arranged such that the first surface of each strip portion lies in contact with the first surface of one next adjacent strip portion and such that the second surface of each strip portion lies in contact with the second surface of the other next adjacent strip portion;

the strip portions being arranged with the first side edges thereof lying on top of and generally aligned with the first side edges of others of the strip portions of the stack and with the second side edges thereof lying on top of and generally aligned with the second side edges of others of the strip portions;

the strip portions being arranged with the first and second surfaces thereof generally parallel to a top surface and bottom surface of the at least one stack;

the at least one stack being substantially upright and having a splice tail portion of the strip extending from a bottom strip portion and extending beyond an end of the at least one stack so as to be accessible for splicing;

wherein the splice tail portion extends along the end of the stack and is folded about at least one fold line generally transverse to its length to define two folded connecting portions; and a slip sheet provided between the two folded connecting portions;

wherein the entire top surface and the entire bottom surface of the at least one stack is compressed from an external force in a direction at right angles to the top surface and the bottom surface of the at least one stack, and the at least one stack is engaged by packaging which maintains the compression.

10. A package comprising:

at least one stack of a strip of material;

the strip having a first side edge, a second side edge, a first surface aid a second surface;

in said at least one stack the strip being repeatedly folded back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of the at least one stack and a plurality of second fold lines at an opposed end of the at least one stack;

the strip portions being arranged such that the first surface of each strip portion lies in contact with the first surface of one next adjacent strip portion and such that the second surface of each strip portion lies in contact with the second surface of the other next adjacent strip portion;

the strip portions being arranged with the first side edges thereof lying on top of and generally aligned with the first side edges of others of the strip portions of the stack and with the second side edges thereof lying on top of and generally aligned with the second side edges of others of the strip portions;

the strip portions being arranged with the first and second surfaces thereof generally parallel to a top surface and bottom surface of the at least one stack;

the at least one stack being substantially upright and having a splice tail portion of the strip extending from a bottom strip portion and extending beyond an end of the at least one stack so as to be accessible for splicing; and a spacer sheet between the fold lines at an end of the stack and the splice tail portion;

wherein the entire top surface and the entire bottom surface of the at least one stack is compressed from an external force in a direction at right angles to the top surface and the bottom surface of the at least one stack, and the at least one stack is engaged by packaging which maintains the compression.

11. A package comprising:

at least one stack of a strip of material;

the strip having a first side edge, a second side edge, a first surface and a second surface;

in said at least one stack the strip being repeatedly folded back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of the at least one stack and a plurality of second fold lines at an opposed end of the at least one stack;

the strip portions being arranged such that the first surface of each strip portion lies in contact with the first surface of one next adjacent strip portion and such that the second surface of each strip portion lies in contact with the second surface of the other next adjacent strip portion;

the strip portions being arranged with the first side edges thereof lying on top of and generally aligned with the first side edges of others of the strip portions of the stack and with the second side edges thereof lying on top of and generally aligned with the second side edges of others of the strip portions;

the strip portions being arranged with the first and second surfaces thereof generally parallel to a top surface and bottom surface of the at least one stack;

the at least one stack being substantially upright and having a splice tail portion of the strip extending from a bottom strip portion and extending beyond an end of the at least one stack so as to be accessible for splicing; and a protection sheet defining at least one pocket for containing and supporting the splice tail portion;

wherein the entire top surface and the entire bottom surface of the at least one stack is compressed from an external force in a direction at right angles to the top surface and the bottom surface of the at least one stack, and the at least one stack is engaged by packaging which maintains the compression.

12. A package comprising:

a plurality of stacks of a strip of material arranged side by side without intervening rigid container walls;

wherein each strip has a first side edge, a second side edge, a first surface and a second surface;

the strip being repeatedly folded back and forth so that each stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of each stack and a plurality of second fold lines at an opposed end of each stack;

the strip portions being arranged such that the first surface of each strip portion lies in contact with the first surface of one next adjacent strip portion and such that the second surface of each strip portion lies in contact with the second surface of the other next adjacent strip portion;

the strip portions being arranged with the first side edges thereof lying on top of and generally aligned with the first side edges of others of the strip portions of the stack and with the second side edges thereof lying on top of and generally aligned with the second side edges of others of the strip portions;

the strip portions being arranged with the first and second surfaces thereof generally parallel to a top surface and bottom surface of each stack;

wherein each stack is substantially upright and has a respective splice tail portion of the strip extending from a bottom strip portion and extending beyond an end of the respective stack so as to be accessible for splicing; and a protection sheet defining at least one pocket for containing and supporting the splice tail portions;

wherein the entire top surface and the entire bottom surface of each stack is compressed from an external force in a direction at right angles to the top surface and the bottom surface of the stack, and the stack is engaged by packaging which maintains the compression.

13. The package according to claim 12 further comprising a spacer sheet between the fold lines at an end of the stacks and the splice tail portions.

14. The package according to claim 12 wherein the protection sheet includes a plurality of pockets each for receiving a respective one of the splice tail portions.

15. The package according to claim 12 wherein the protection sheet is a spacer sheet positioned between the fold lines at an end of the stack and the splice tail portions and has at least one pocket carried on the spacer sheet for retaining the splice tail portions.

16. The package according to claim 15 wherein each splice tail portion is connected by a splice to a top strip portion of a next adjacent stack to define a splice connection portion extending from the bottom strip portion of one stack to the top strip portion of the next adjacent stack;

wherein when the stacks are compressed such that a length of the splice connection portion is longer than the height of the compressed stacks, thus defining an excess length portion, an excess length portion of each splice connecting portion is inserted into the at least one pocket.

17. The package according to claim 15 wherein the at least one pocket comprises a sleeve mounted on an outer surface of the spacer sheet defining an open top and an open bottom.

18. The package according to claim 17 wherein each splice tail portion is connected by a splice to a top strip portion of a next adjacent stack to define a splice connection portion extending from the bottom strip portion of one stack to the top strip portion of the next adjacent stack;

wherein when the stacks are compressed such that a length of each splice connection portion is longer than the height of the compressed stacks this creating an excess length portion, a first excess length portion of each splice connecting portion is inserted into the open top of a respective one of the pockets and a second excess length portion of each splice connecting portion is inserted into the open bottom of a respective one of the pockets.

19. A method of forming a package comprising:

providing at least one stack of strip material by folding the strip repeatedly back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of the at least one stack and a plurality of second fold lines at an opposed end of the at least one stack;

arranging the strip portions such that the first surface of each strip portion lies in contact with the first surface of one next adjacent strip portion and such that the second surface of each strip portion lies in contact with the second surface of the other next adjacent strip portion;

arranging the strip portions with the first side edges thereof lying on top of and aligned with the first side edges of others of the strip portions of the stack and with the second side edges thereof lying on top of and aligned with the second side edges of others of the strip portions;

arranging the strip portions with the first and second surfaces thereof generally parallel to a top surface and bottom surface of the at least one stack;

arranging the at least one stack substantially upright and providing a splice tail portion of the strip extending from a bottom strip portion beyond an end of the at least one stack so as to be accessible for splicing;

compressing the entire top surface and the entire bottom surface of the at least one stack with an external force in a direction at right angles to the top surface and the bottom surface of the at least one stack; and engaging the at least one stack by packaging to maintain the compression including surrounding the package with a bag, withdrawing air from the bag and sealing the bag against ingress of air.

20. A method of forming a package comprising:

providing at least one stack of fibrous strip material by folding the strip repeatedly back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of the at least one stack and a plurality of second fold lines at an opposed end of the at least one stack;

arranging the strip portions such that the first surface of each strip portion lies in contact with the first surface of one next adjacent strip portion and such that the second surface of each strip portion lies in contact with the second surface of the other next adjacent strip portion;

arranging the strip portions with the first side edges thereof lying on top of and aligned with the first side edges of others of the strip portions of the stack and with the second side edges thereof lying on top of and aligned with the second side edges of others of the strip portions;

arranging the strip portions with the first and second surfaces thereof generally parallel to a top surface and bottom surface of the at least one stack;

arranging the at least one stack substantially upright and providing a splice tail portion of the strip extending from a bottom strip portion beyond an end of the at least one stack so as to be accessible for splicing;

compressing the entire top surface and the entire bottom surface of the at least one stack with an external force in a direction at right angles to the top surface and the bottom surface of the at least one stack;

wherein compressing the stack includes applying a compression forced to reduce the thickness of each strip portion of said at least one stack and compressing the stack includes compressing each strip portion by expelling air from interstices between the fibers; and engaging the at least one stack by packaging to maintain the compression.

21. A method of forming a package comprising:

providing at least one stack of fibrous strip material by folding the strip repeatedly back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of the at least one stack and a plurality of second fold lines at an opposed end of the at least one stack;

arranging the strip portions such that the first surface of each strip portion lies in contact with the first surface of one next adjacent strip portion and such that the second surface of each strip portion lies in contact with the second surface of the other next adjacent strip portion;

arranging the strip portions with the first side edges thereof lying on top of and aligned with the first side edges of others of the strip portions of the stack and with the second side edges thereof lying on top of and aligned with the second side edges of others of the strip portions;

arranging the strip portions with the first and second surfaces thereof generally parallel to a top surface and bottom surface of the at least one stack;

arranging the at least one stack substantially upright and providing a splice tail portion of the strip extending from a bottom strip portion beyond an end of the at least one stack so as to be accessible for splicing;

compressing the entire top surface and the entire bottom surface of the at least one stack with an external force in a direction at right angles to the top surface and the bottom surface of the at least one stack and compressing the stack includes compressing each strip portion by expelling air from interstices between the fibers; and engaging the at least one stack by packaging to maintain the compression.

22. A method of forming a package comprising:

providing at least one stack of strip material by folding the strip repeatedly back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of the at least one stack and a plurality of second fold lines at an opposed end of the at least one stack;

arranging the strip portions such that the first surface of each strip portion lies in contact with the first surface of one next adjacent strip portion and such that the second surface of each strip portion lies in contact with the second surface of the other next adjacent strip portion;

arranging the strip portions with the first side edges thereof lying on top of and aligned with the first side edges of others of the strip portions of the stack and with the second side edges thereof lying on top of and aligned with the second side edges of others of the strip portions;

arranging the strip portions with the first and second surfaces thereof generally parallel to a top surface and bottom surface of the at least one stack;

arranging the at least one stack substantially upright and providing a splice tail portion of the strip extending from a bottom strip portion beyond an end of the at least one stack so as to be accessible for splicing;

compressing the entire top surface and the entire bottom surface of the at least one stack with an external force in a direction at right angles to the top surface and the bottom surface of the at least one stack wherein compressing the stacks includes providing two rigid header plates with each engaging a respective one of a top surface and a bottom surface of the package and applying pressure thereto for maintaining the compression; and engaging the at least one stack by packaging to maintain the compression.

23. A method of forming a package comprising:

providing at least one stack of strip material by folding the strip repeatedly back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of the at least one stack and a plurality of second fold lines at an opposed end of the at least one stack;

arranging the strip portions such that the first surface of each strip portion lies in contact with the first surface of one next adjacent strip portion and such that the second surface of each strip portion lies in contact with the second surface of the other next adjacent strip portion;

arranging the strip portions with the first side edges thereof lying on top of and aligned with the first side edges of others of the strip portions of the stack and with the second side edges thereof lying on top of and aligned with the second side edges of others of the strip portions;

arranging the strip portions with the first and second surfaces thereof generally parallel to a top surface and bottom surface of the at least one stack;

arranging the at least one stack substantially upright and providing a splice tail portion of the strip extending from a bottom strip portion beyond an end of the at least one stack so as to be accessible for splicing wherein the splice tail portion extends along the end of the stack;

folding the splice tail portion about at least one fold line generally transverse to its length to define two folded, strip portions;

providing a slip sheet between the two folded strip portions;

compressing the entire top surface and the entire bottom surface of the at least one stack with an external force in a direction at right angles to the top surface and the bottom surface of the at least one stack; and engaging the at least one stack by packaging to maintain the compression.

24. A method of forming a package comprising:

providing at least one stack of strip material by folding the strip repeatedly back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of the at least one stack and a plurality of second fold lines at an opposed end of the at least one stack;

arranging the strip portions such that the first surface of each strip portion lies in contact with the first surface of one next adjacent strip portion and such that the second surface of each strip portion lies in contact with the second surface of the other next adjacent strip portion;

arranging the strip portions with the first side edges thereof lying on top of and aligned with the first side edges of others of the strip portions of the stack and with the second side edges thereof lying on top of and aligned with the second side edges of others of the strip portions;

arranging the strip portions with the first and second surfaces thereof generally parallel to a top surface and bottom surface of the at least one stack;

arranging the at least one stack substantially upright and providing a splice tail portion of the strip extending from a bottom strip portion beyond an end of the at least one stack so as to be accessible for splicing;

providing a spacer sheet between the fold lines at an end of the stack and the splice tail portion;

compressing the entire top surface and the entire bottom surface of the at least one stack with an external force in a direction at right angles to the top surface and the bottom surface of the at least one stack; and engaging the at least one stack by packaging to maintain the compression.

25. A method of forming a package comprising:

providing a plurality of stacks of strip material by folding each strip repeatedly back and forth so that each stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of the at least one stack and a plurality of second fold lines at an opposed end of the at least one stack;

arranging the strip portions such that the first surface of each strip portion lies in contact with the first surface of one next adjacent strip portion and such that the second surface of each strip portion lies in contact with the second surface of the other next adjacent strip portion;

arranging the strip portions with the first side edges thereof lying on top of and aligned with the first side edges of others of the strip portions of the stack and with the second side edges thereof lying on top of and aligned with the second side edges of others of the strip portions;

arranging the strip portions with the first and second surfaces thereof generally parallel to a top surface and bottom surface of the at least one stack;

arranging the plurality of the stacks side by side without intervening rigid container walls, wherein each stack has a respective splice tail portion extending beyond an end of the respective stack;

positioning a spacer sheet between the fold lines at an end of the stacks and the splice tail portions;

providing a protection sheet defining at least one pocket for containing and supporting the splice tail portions;

compressing the entire top surface and the entire bottom surface of the plurality of stacks with an external force in a direction at right angles to the top surface and the bottom surface of each stack; and engaging the plurality of stacks by packaging to maintain the compression.

26. A method of forming a package comprising:

providing at least one stack of strip material by folding the strip repeatedly back and forth so that the stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of the at least one stack and a plurality of second fold lines at an opposed end of the at least one stack;

arranging the strip portions such that the first surface of each strip portion lies in contact with the first surface of one next adjacent strip portion and such that the second surface of each strip portion lies in contact with the second surface of the other next adjacent strip portion;

arranging the strip portions with the first side edges thereof lying on top of and aligned with the first side edges of others of the strip portions of the stack and with the second side edges thereof lying on top of and aligned with the second side edges of others of the strip portions;

arranging the strip portions with the first and second surfaces thereof generally parallel to a top surface and bottom surface of the at least one stack;

arranging the at least one stack substantially upright and providing a splice tail portion of the strip extending from a bottom strip portion beyond an end of the at least one stack so as to be accessible for splicing;

providing a protection sheet with at least one pocket to contain and support the splice tail portion;

compressing the entire top surface and the entire bottom surface of the at least one stack with an external force in a direction at right angles to the top surface and the bottom surface of the at least one stack; and engaging the at least one stack by packaging to maintain the compression.

27. A method of forming a package comprising:

providing a plurality of stacks of strip material arranged side by side without intervening rigid container walls by folding the strip repeatedly back and forth so that each stack contains a plurality of folded overlying strip portions of the strip, with each strip portion being folded relative to one next adjacent strip portion about a first fold line transverse to the strip and relative to a second next adjacent strip portion about a second fold line transverse to the strip and spaced from the first fold line;

the strip portions forming a plurality of first fold lines at one end of the stacks and a plurality of second fold lines at an opposed end of the stacks;

arranging the strip portions such that the first surface of each strip portion lies in contact with the first surface of one next adjacent strip portion and such that the second surface of each strip portion lies in contact with the second surface of the other next adjacent strip portion;

arranging the strip portions with the first side edges thereof lying on top of and aligned with the first side edges of others of the strip portions of the stack and with the second side edges thereof lying on top of and aligned with the second side edges of others of the strip portions;

arranging the strip portions with the first and second surfaces thereof generally parallel to a top surface and bottom surface of the stacks;

providing for each stack a respective splice tail portion extending beyond an end of the respective stack;

providing a protection sheet with at least one pocket to contain and support the splice tail portions;

compressing the entire top surface and the entire bottom surface of the stacks with an external force in a direction at right angles to the top surface and the bottom surface of the stacks; and engaging the stacks by packaging to maintain the compression.

28. The method according to claim 27 wherein the protection sheet is provided with a plurality of pockets each for receiving a respective one of the splice tail portions.

29. The method according to claim 27 wherein the protection sheet is a spacer sheet and the method includes positioning the spacer sheet between the fold lines at an end of the stack and the splice tail portions with at least one pocket carried on the spacer sheet for containing the splice tail portions.

30. The method according to claim 29 including connecting each splice tail portion by a splice to a top strip portion of a next adjacent stack to define a splice connection portion extending from the bottom strip portion of one stack to the top strip portion of the next adjacent stack and wherein the stacks are compressed such that a length of the splice connection portion is longer than the height of the compressed stacks thus forming an excess length portion, wherein the excess length portion of each splice connecting portions is inserted into the at least one pocket.

31. The method according to claim 30 wherein the at least one pocket is formed as a sleeve mounted on an outer surface of the spacer sheet defining an open top and an open bottom.

32. The method according to claim 30 including connecting each splice tail portion by a splice to a top strip portion of a next adjacent stack to define a splice connection portion extending from the bottom strip portion of one stack to the top strip portion of the next adjacent stack, wherein the stacks are compressed such that a length of each splice connection portion er than the height of the compressed stacks to form an excess length portion, wherein a first excess length portion of each splice connecting portion is inserted into the open top of a respective one of the pockets and a second excess length portion of each splice connecting portion is inserted into the open bottom of a respective one of the pockets.

* * * * *

UNITED STATES PATENT AND TRADEMARK OFFICE

CERTIFICATE OF CORRECTION

PATENT NO. : 6,321,511 B1
DATED : November 27, 2001
INVENTOR(S) : Lawrence J. O'Connor et al.

It is certified that error appears in the above-identified patent and that said Letters Patent is hereby corrected as shown below:

Title page,
Item [63], Related U.S. Application Data, delete "08/948,258" and substitute -- 08/948,256 --; delete "08/899,737" and substitute -- 08/889,737 --

Signed and Sealed this

Sixteenth Day of December, 2003

JAMES E. ROGAN
*Director of the United States Patent and Trademark Office*